US008231190B2

(12) United States Patent
Ertz et al.

(10) Patent No.: US 8,231,190 B2
(45) Date of Patent: Jul. 31, 2012

(54) ARTICULATED FREEZER DRAWERS

(75) Inventors: Lawrence J. Ertz, Amana, IA (US); Pawan Mansukhlal Gandhi, Maharashtra (IN); Todd E. Kniffen, Williamsburg, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 647 days.

(21) Appl. No.: 12/363,833

(22) Filed: Feb. 2, 2009
(Under 37 CFR 1.47)

(65) Prior Publication Data

US 2009/0193836 A1 Aug. 6, 2009

Related U.S. Application Data

(60) Provisional application No. 61/025,349, filed on Feb. 1, 2008.

(51) Int. Cl.
*A47B 96/04* (2006.01)

(52) U.S. Cl. ..... 312/402; 312/404; 312/323

(58) Field of Classification Search ..... 312/402, 312/404, 323, 311, 271, 273
See application file for complete search history.

(56) References Cited

U.S. PATENT DOCUMENTS 1,934,370 A * 11/1933 Mirabella ..... 312/266
2,092,430 A 9/1937 Stratton
2,103,885 A 12/1937 Whalen
2,125,989 A 8/1938 Burch
2,375,359 A 5/1945 Hedlund
2,486,564 A * 11/1949 Kamin ..... 126/41 E
2,525,201 A 10/1950 Beynon et al.
2,549,664 A 4/1951 Collins
2,614,020 A 10/1952 Collins
2,780,926 A 2/1957 Sharpe
2,819,141 A 1/1958 Myer
2,926,507 A 3/1960 Ingolia
2,953,287 A * 9/1960 Werner ..... 224/496
3,195,970 A 7/1965 Chuboff
3,212,835 A 10/1965 Beckett et al.
4,790,146 A 12/1988 Mun et al.
5,115,822 A 5/1992 Nichols
5,819,669 A * 10/1998 Eyre ..... 108/147
5,971,513 A * 10/1999 Cassalia ..... 312/310
6,247,771 B1 * 6/2001 Miller ..... 312/310
(Continued)

FOREIGN PATENT DOCUMENTS

DE 4219085 A1 12/1993
(Continued)

*Primary Examiner* — Darnell Jayne
*Assistant Examiner* — Daniel Rohrhoff
(74) *Attorney, Agent, or Firm* — Kirk W. Goodwin; Robert L. Judd

(57) ABSTRACT

The invention relates generally to an articulating drawer for a bottom mount freezer refrigerator. The drawer can be slideably mounted in the freezer compartment on slides that can include pivots to pivotally mount a drawer front on the slides. A support mechanism can mount a food storage basket for movement with the drawer front and movable slides and can move the food storage basket upward when the door is moved to the open position. The support mechanism can include a pair of guide plates connected to the slides having a guide surface arranged to be engaged by a food storage basket guide surface follower and a pair of links each connected to the drawer front at one end and having a first link pivot at a distal end arranged to pivotally connect to a food storage basket pivot.

14 Claims, 19 Drawing Sheets

U.S. PATENT DOCUMENTS

| | | | | |
|---|---|---|---|---|
| 7,232,196 | B2 * | 6/2007 | Kwon et al. | 312/402 |
| 7,533,947 | B2 * | 5/2009 | Kim et al. | 312/402 |
| 7,628,461 | B2 * | 12/2009 | Carden et al. | 312/402 |
| 7,794,027 | B2 * | 9/2010 | Calabria et al. | 312/311 |
| 2004/0163687 | A1 * | 8/2004 | Son et al. | 134/58 D |
| 2004/0244825 | A1 | 12/2004 | Ashton | |
| 2006/0013677 | A1 | 1/2006 | Oh et al. | |
| 2006/0021373 | A1 | 2/2006 | Oh et al. | |
| 2006/0022564 | A1 | 2/2006 | Oh et al. | |
| 2006/0042299 | A1 | 3/2006 | Oh et al. | |
| 2006/0042301 | A1 | 3/2006 | Oh et al. | |
| 2006/0042302 | A1 | 3/2006 | Oh et al. | |
| 2006/0042303 | A1 | 3/2006 | Oh et al. | |
| 2006/0042304 | A1 | 3/2006 | Oh et al. | |
| 2006/0042305 | A1 | 3/2006 | Oh et al. | |
| 2006/0043848 | A1 * | 3/2006 | Jeong et al. | 312/310 |
| 2006/0043849 | A1 | 3/2006 | Oh et al. | |
| 2006/0049731 | A1 | 3/2006 | Choi et al. | |
| 2006/0087207 | A1 | 4/2006 | Oh et al. | |
| 2006/0087208 | A1 | 4/2006 | Oh et al. | |
| 2006/0096304 | A1 | 5/2006 | Kim et al. | |
| 2006/0097611 | A1 | 5/2006 | Kim et al. | |
| 2006/0103273 | A1 * | 5/2006 | Lee et al. | 312/236 |
| 2006/0104756 | A1 * | 5/2006 | Kim et al. | 414/288 |
| 2006/0196198 | A1 | 9/2006 | Kim et al. | |
| 2006/0207283 | A1 * | 9/2006 | Kim et al. | 62/407 |
| 2006/0226749 | A1 * | 10/2006 | Kim | 312/404 |
| 2006/0242988 | A1 | 11/2006 | Kim et al. | |
| 2007/0035221 | A1 * | 2/2007 | Koo | 312/404 |
| 2007/0035222 | A1 * | 2/2007 | Lee et al. | 312/405 |

FOREIGN PATENT DOCUMENTS

| | | | |
|---|---|---|---|
| JP | 5296647 | A | 11/1993 |
| WO | 2007/040290 | A1 | 4/2007 |

* cited by examiner

ARTICULATED FREEZER DRAWERS

CROSS-REFERENCE TO RELATED APPLICATIONS

The present application claims the benefit of U.S. Provisional Patent Application Ser. No. 61/025,349 filed Feb. 1, 2008 entitled "Articulated Freezer Drawer."

BACKGROUND OF THE INVENTION

1. Field of the Invention

The invention relates to refrigerator freezers, and in particular to bottom mount freezer refrigerators.

2. Description of the Related Art

Bottom mount freezer refrigerators having freezer drawers in lieu of a freezer compartment having a conventional insulated door are known. In addition, slide out freezer drawers having an arrangement for lifting or elevating all or a portion of the drawer and or contents to facilitate access by a user are known. U.S. patent application Ser. No. 11/489,450, now U.S. Pat. No. 7,628,461, discloses embodiments of a bottom mount freezer refrigerator having an elevating freezer basket.

BRIEF SUMMARY OF THE INVENTION

In one aspect the present invention relates to a refrigerator having at least one insulated compartment can include a pair of fixed slides attached to opposite side walls of the inner surface of the at least one compartment and a pair of movable slides combined with the fixed slides to be movable forward and back with respect to the fixed slides and having a distal end. Door pivots can be connected to the movable slides adjacent the distal ends and an insulated compartment door can be pivotally mounted to the door pivots for movement with the movable slides between a closed position closing the insulated compartment and an open position. A food storage basket can be provided having a pair of opposite sides with a basket pivot and a guide surface follower positioned on each of the opposite sides, and a support mechanism for mounting the food storage basket for movement with the compartment door and movable slides and for moving the food storage basket upward when the door is moved to the open position can be provided. The support mechanism can include a pair of guide plates each connected to the movable slides and having a guide surface arranged to be engaged by a food storage basket guide surface follower; and a pair of links connected to the insulated compartment door at one end and having a first link pivot at a distal end arranged to pivotally connect to a food storage basket pivot. The links can include a second link pivot arranged to pivotally connect the insulated compartment door to the movable slides.

The guide surface followers can comprise a roller arranged to roll along the guide surface to maintain the food basket in a generally upright orientation as the food storage basket is moved upward when the door is moved to the open position.

In another aspect the invention relates to a refrigerator having at least one insulated compartment including a pair of fixed slides attached to opposite side walls of the inner surface of the at least one compartment, a pair of movable slides combined with the fixed slides to be movable forward and back with respect to the fixed slides and having a distal end. An elongated bracket can be attached to each of the movable slides including a door pivot located on the bracket adjacent the distal end of the movable slide. An insulated compartment door can be pivotally mounted to the door pivots for movement with the movable slides between a closed position closing the insulated compartment and an open position. A first food storage basket having a front wall, opposite side walls, a rear wall and a bottom wall and having a basket pivot and a guide surface follower attached to each of the opposite side walls can be provided with a support mechanism for mounting the first food storage basket for movement with the compartment door and movable slides and for rotating the first food storage basket upward from a lower position to an upper position when the door is moved to the open position. The support mechanism can include a guide plate connected to each of the brackets and having a guide surface arranged to be engaged by a guide surface follower, and a pair of links connected to the insulated compartment door at one end and having a first link pivot at a distal end arranged to pivotally connect to a basket pivot and a second link pivot arranged to pivotally connect to a door pivot to pivotally connect the insulated compartment door to the brackets attached to the movable slides.

The support mechanism can include a stopper that can include the door pivots and second link pivots that can limit rotation of the food storage basket between the lower position and the upper position. The door pivots can include an axially extending partial collar forming a first stopping surface and a second stopping surface, and the second link pivots can include an axially extending partial collar forming a pin having a first surface and a second surface. The links can be arranged for limited rotation relative to the brackets between a first position where the first surface of the pin engages the first stopping surface and a second position where the second surface of the pin engages the second stopping surface.

The refrigerator can include a latching mechanism to restrict rotation of the insulated compartment door until the door is in the open position.

DESCRIPTION OF THE INVENTION

Figure 1A:
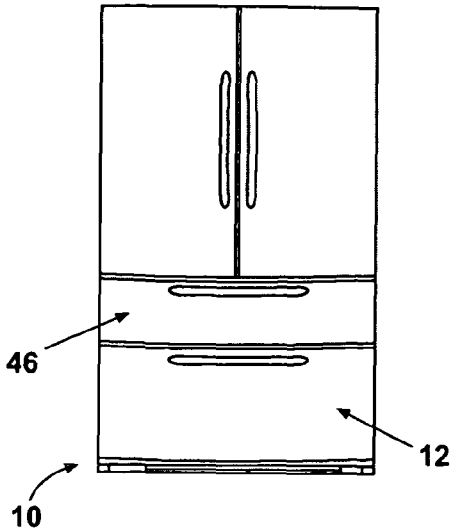
FIG. 1A is a front view of a bottom mount refrigerator having a freezer drawer according to the invention.
Figure 1B:
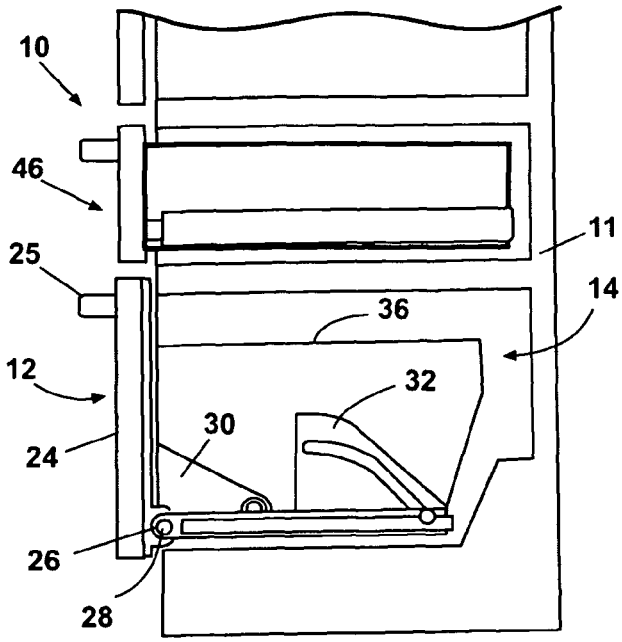
FIG. 1B is a partial schematic side view of the embodiment of FIG. 1A.
Figure 1C:
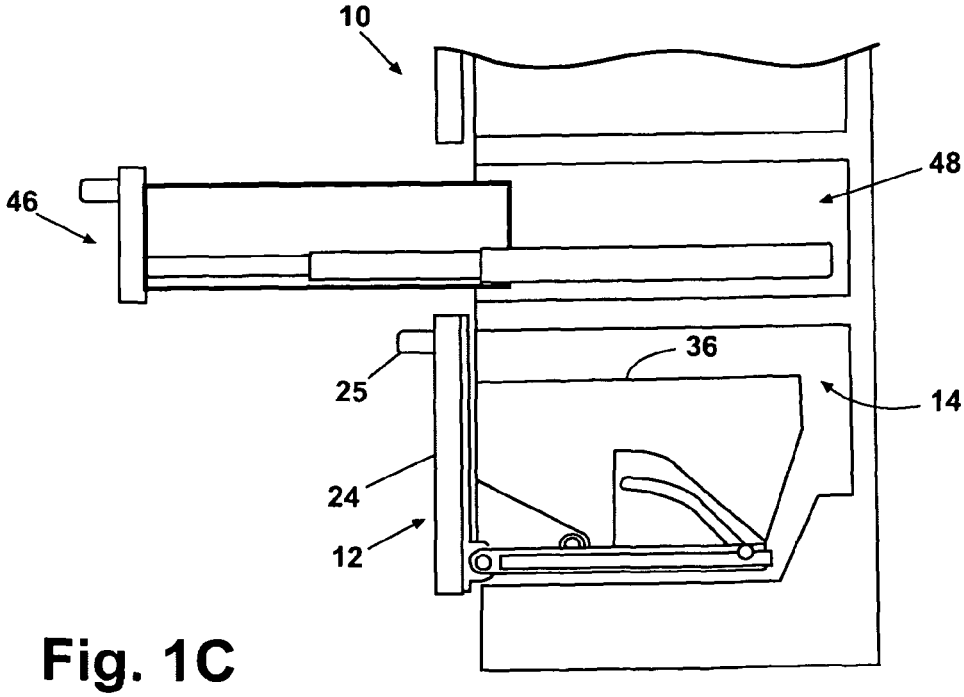
FIG. 1C is a partial schematic side view of the embodiment of FIG. 1A with the upper freezer drawer open.
Figure 1D:
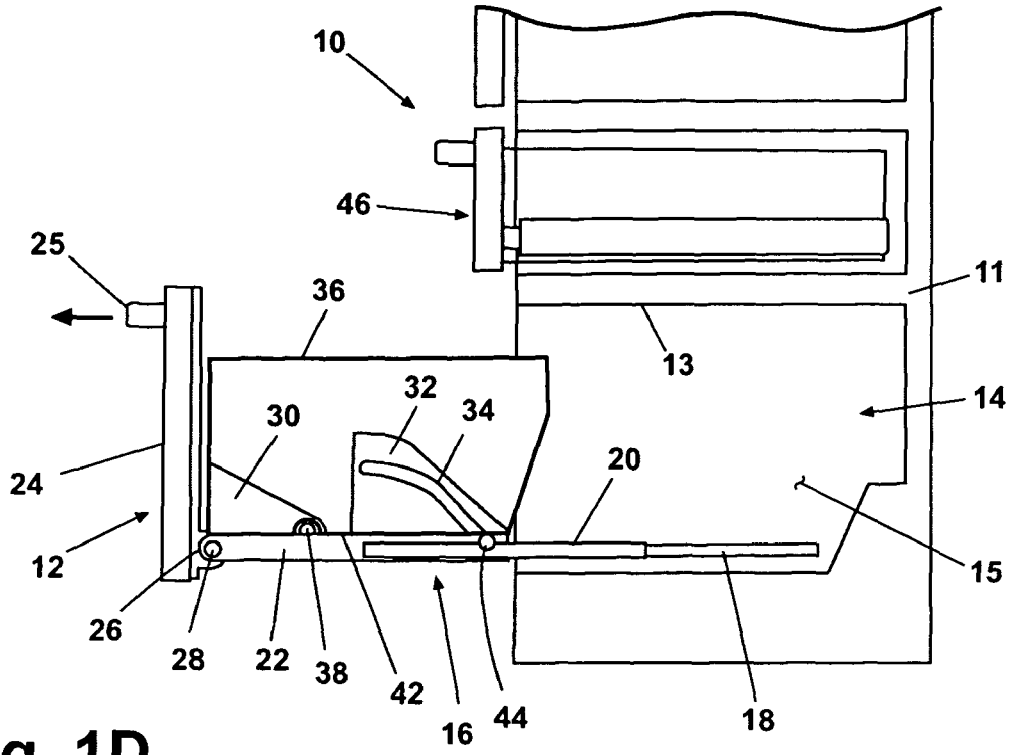
FIG. 1D is a partial schematic side view of one embodiment of the invention showing the freezer drawer in a partially open position.
Figure 1E:
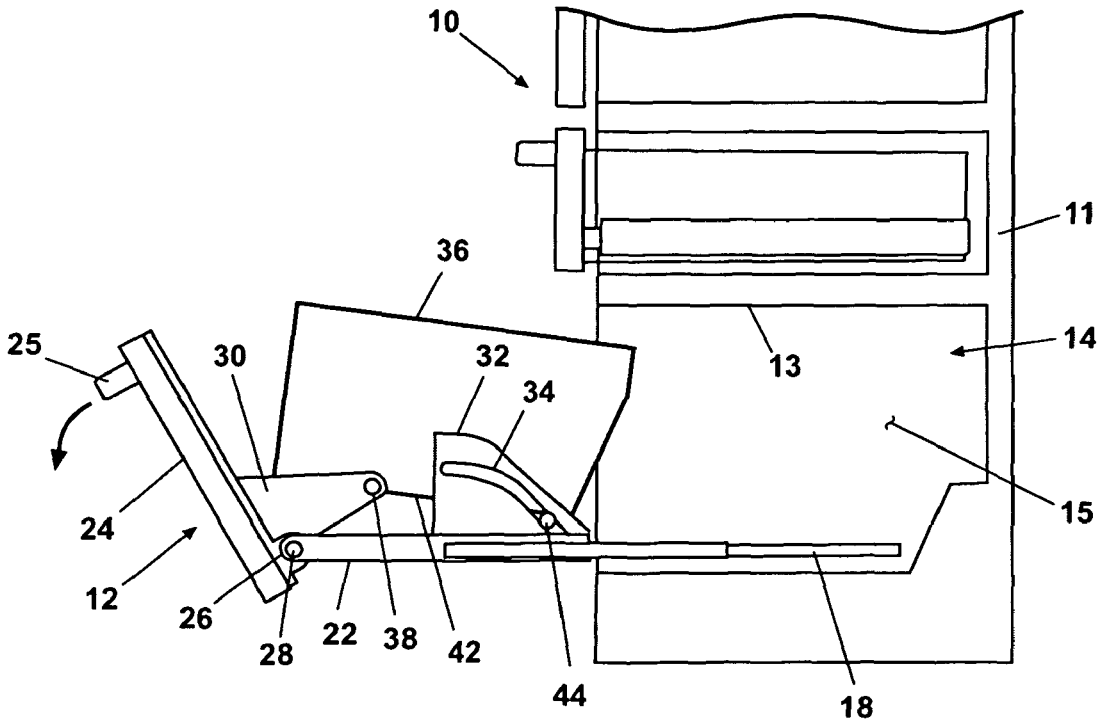
FIGS. 1E-1G are partial schematic side views of the freezer drawer of FIG. 1A with the drawer progressively opened to the position in FIG. 1G with the drawer fully open and lifted.

The invention is described with connection with several embodiments. It is to be understood that the invention is not to be limited by or to the embodiments disclosed in this non-provisional application.

The invention relates generally to articulating or lift arrangements for drawers for bottom mount freezer refrigerators. Many consumers prefer bottom mount freezer refrigerators for freezer storage space and ease of access to a refrigerator compartment positioned above the freezer compartment. However, consumers would also prefer improved ergonomics and storage options for the bottom mount freezer compartment.

Turning to FIGS. 1A-1G one embodiment of a freezer drawer for a bottom mount freezer refrigerator can be seen. Bottom mount freezer refrigerator 10 can have an insulated cabinet 11 and can have a slide out drawer 12 that can be slideably mounted in the bottom freezer compartment 14 on slide out tracks 16 mounted on opposite side walls 15 of freezer compartment 14. Slide out tracks 16 can be conventional triple slide tracks as are well known in the art. Slide out tracks 16 can include a first slide 18 that can be fastened to the side walls 15 of freezer compartment 14 using conventional mounting hardware. Slide out track 16 can have a second slide 20 slideably carried by first slide 18 and a third slide 22 slideably carried by second slide 20. An insulated drawer front 24 can be pivotally attached to the third slides 22 at pivot 26 that can be provided on each side of drawer front 24 to align with slides 16. A pivot pin 28 can pivotally connect pivot 26 to third slide 22 to pivotally mount drawer front 24 to third slide 22. Those skilled in the art will understand that a slide out track 16 can be provided on both sidewalls 15 of freezer compartment 14 to pivotally support drawer front 24. While a simple pivot and pivot pin is shown in FIGS. 1A-1G, any suitable hinge arrangement can be provided to pivotally connect drawer front 24 to slides 16. A suitable biasing arrangement such as a torsion spring, not shown, can be provided to bias drawer front to the upright position, or drawer front 24 can have a latch arrangement that can be a spring loaded button and detent, not shown, to hold drawer front 24 in the upright position until slide out drawer 12 is in the position illustrated in FIG. 1D.

Drawer front 24 can have a front bracket 30, sometimes referred to as a link, provided on each side of drawer front 24 that can be connected to drawer front 24 adjacent pivots 26. A rear bracket 32, sometimes referred to as a guide plate, can be attached to each of the third slides 22 toward or at the rear end of third slides 22. Rear brackets 32 can have a "wave shaped" slot 34, sometimes referred to as a guide surface, that rise from the rear lower portion of rear bracket 32 to the top front of rear bracket 32 as shown in FIGS. 1A-1G.

Figure 1F:
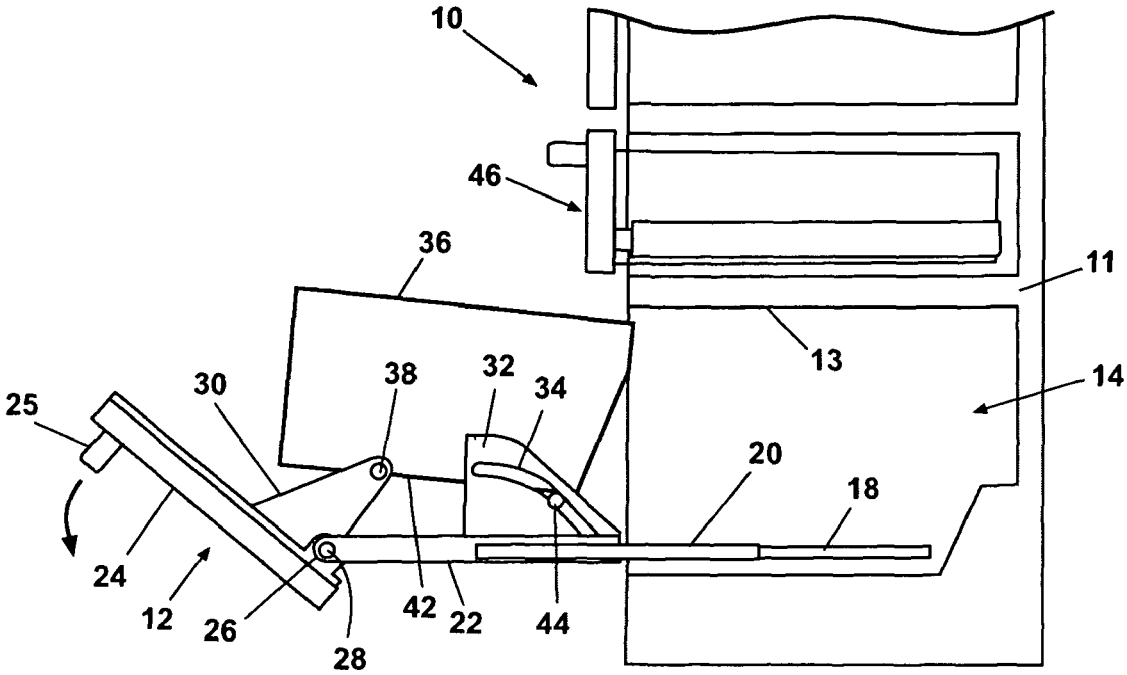
Figure 1G:
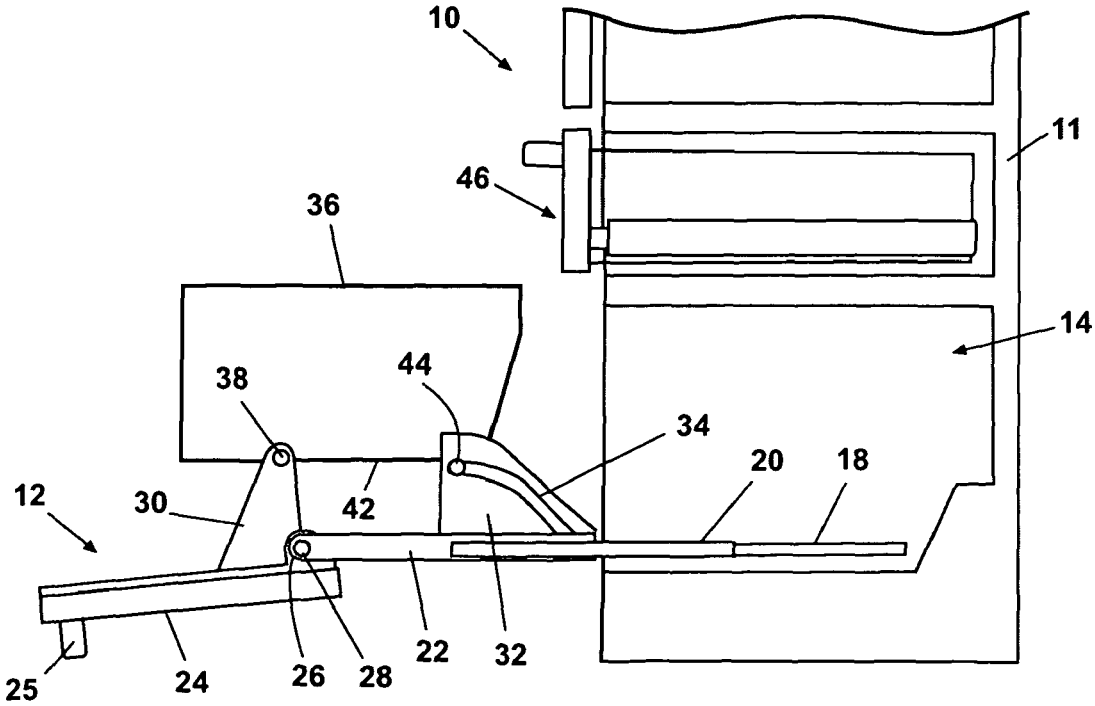

A freezer basket 36, sometimes referred to as a food storage basket, can be supported for slidable movement into and out of freezer compartment 14. Freezer basket 36 as illustrated in FIGS. 1A-1G can be a wire basket. However, those skilled in the art will understand that a molded plastic basket or other basket structure can be used if desired. Front brackets 30 can have a fixed post 38, sometimes referred to as a food storage basket pivot or simply a basket pivot, extending inwardly from the front bracket in a direction parallel to the axis of pivot pins 28. Freezer basket 36 can have "doughnut" bearing wheels, not shown, positioned along the bottom edges 42 of freezer basket 36 that engage fixed posts or hubs 38 to pivotally connect the front portion of freezer basket 36 to front brackets 30 connected to drawer front 24. Those skilled in the art will appreciate that other pivotal connecting arrangements can be provided to pivotally connect freezer basket 36 to front brackets 30. Freezer basket 36 can also have tracking posts 44, sometimes referred to as guide surface followers, that can be positioned on the sides of freezer basket 36 adjacent the rear bottom corners of basket 36 positioned to engage slots 34 in the rear brackets 32 connected to third slides 22. Thus, freezer basket 36 is movably connected to slides 16 to allow freezer basket 36 to be withdrawn from freezer compartment 14 as drawer front 24 is opened by pulling on handle 25. When freezer drawer front 24 has been withdrawn to the point illustrated in FIG. 1E drawer front 24 can begin to pivot on pivot pins 28 causing the front portion of freezer basket 36 to begin rising as front bracket 30 rotates with drawer front 24. As drawer front 24 rotates and raises the front portion of freezer basket 36, freezer basket 36 begins to move forward relative to third slide 22 and tracking post 44 begins to move along slot 34 causing the rear portion of freezer basket 36 to begin to elevate as shown in FIG. 1F. As drawer front 24 continues to rotate to the fully open position shown in FIG. 1G, freezer basket 36 continues to elevate with the front portion of freezer basket 36 moving upward and outward with fixed post 38 and the rear portion moving upward as tracking post 44 moves up slot 34 to the position illustrated in FIG. 1G.

In order to close the freezer drawer, drawer front 24 is lifted and then pushed inward causing the front portion of freezer basket 36 to move downward as front bracket 30 rotates with the drawer front and the rear portion of freezer basket 36 to move downward as tracking posts 44 travel down slots 34 as freezer basket 36 moves back into freezer compartment 14.

Drawer front 24 can include a biasing arrangement to bias drawer front 24 to the upright position (FIG. 1A-1D) and can have an interlock or latching arrangement to prevent drawer front 24 from pivoting (FIG. 1E) until freezer basket 36 has substantially cleared freezer compartment 14 so that the top edge of freezer basket 36 does not interfere with top wall 13 of freezer compartment or upper drawer 46 as the rear portion of freezer basket 36 begins to elevate as tracking posts 44 begin to move forward and upward in slots 34 in rear brackets 32. Freezer basket 36 can include a lift assist arrangement, not shown, to assist in lifting freezer basket 36 as drawer front 24 is withdrawn from freezer compartment 14 and rotated to the open position (FIGS. 1E-1G) as desired and a damping mechanism, not shown, that can help control movement of the food storage basket down to the position illustrated in FIG. 1D.

Also as shown in FIGS. 1A-1G bottom freezer refrigerator 10 can have an upper drawer 46 that can be slideably mounted in bottom freezer refrigerator 10. In the embodiment illustrated in FIGS. 1A-1G upper drawer 46 is shown slideably mounted in an upper drawer compartment 48 that can be operated as a below freezing freezer compartment or can be arranged to operate as an above freezing refrigerator compartment, or can be operated selectively as a freezer or as a refrigerator compartment as is well know in the art. Alternately, upper drawer 46 can be positioned in freezer compartment 14 if desired. Upper drawer 46 can be slideably mounted on conventional slides as are well known in the art.

Turning to FIGS. 2A-2F another embodiment of a freezer drawer for a bottom mount freezer refrigerator can be seen. Bottom mount freezer refrigerator 50 can have a freezer drawer 52 that can be slideably mounted in freezer compartment 54 of bottom freezer refrigerator 50. Bottom mount freezer refrigerator 50 can have a refrigerator compartment and refrigerator compartment doors, not shown, as are well known in the art. Freezer drawer 52 can include an insulated drawer front 58 having an inner door panel 61. Drawer front 58 can have a suitable handle 59 to facilitate opening and closing freezer drawer 52. Freezer compartment 54 can have a pair of slide out tracks 60 that can be mounted on the sidewalls of freezer compartment 54 as is well known to those skilled in the art. Slide out tracks 60 can include a fixed slide element 63 and an outer slide element 74. Slide out tracks 60 can alternately be triple slide tracks that can be similar to the slide out tracks illustrated in FIGS. 1A-1G if desired.

Freezer drawer 52 can include an upper basket 56 that can be slideably mounted in freezer compartment 54. Upper basket 56 can be slideably carried on an upper basket slide out track 57 that can be mounted on the sidewalls of freezer compartment 54 as is well known to those skilled in the art. Freezer drawer 52 can also have a lower drawer 62, sometimes referred to as a food storage basket. Lower drawer 62 is illustrated in FIGS. 2A-2F as a plastic basket. However, those skilled in the art will understand that a wire basket as illustrated in FIGS. 1A-1G can be provided for the lower drawer if desired.

Figure 2A:
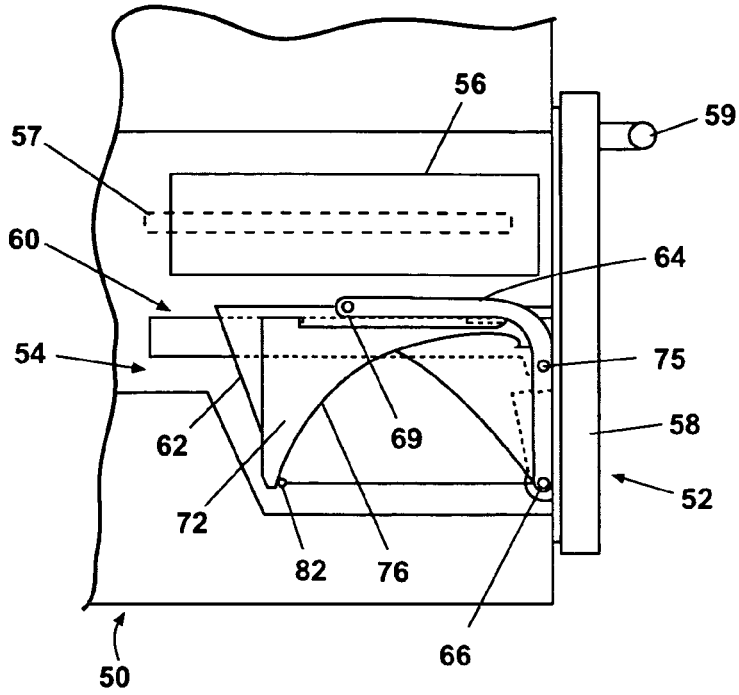
FIG. 2A is a partial schematic side view of another embodiment of the invention showing a bottom mount freezer drawer in a closed position.
Figure 2B:
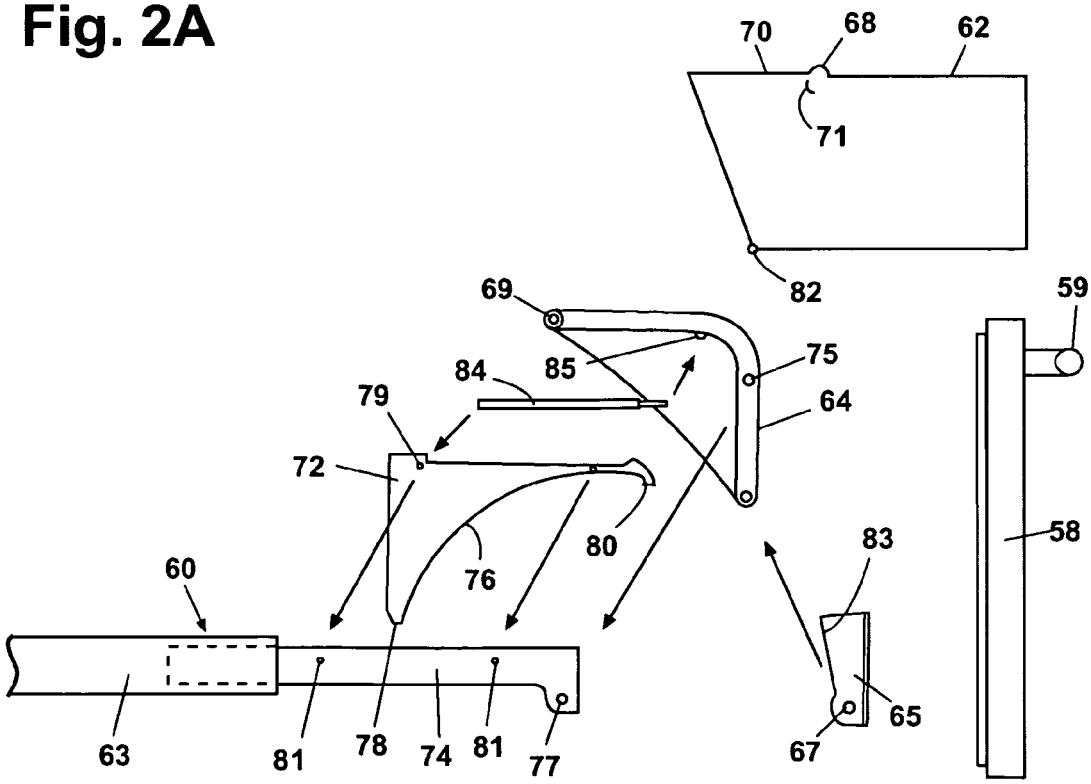
FIG. 2B is a schematic exploded side view of certain components of the freezer drawer of FIG. 2A.
Figure 2C:
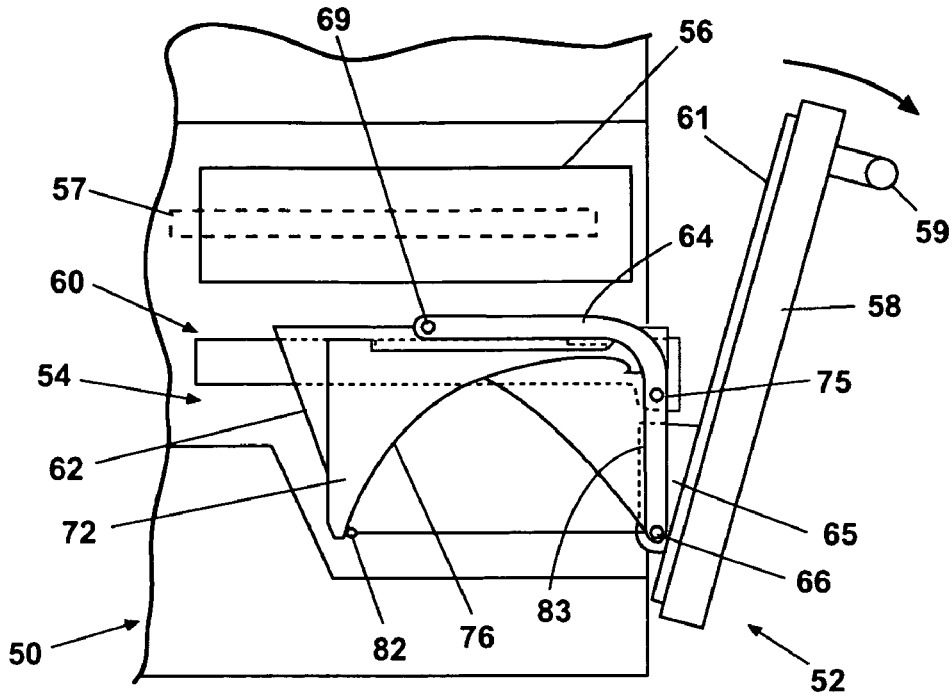
FIG. 2C-2F are partial schematic side views of the freezer drawer of FIG. 2A with the drawer progressively opened to the position in FIG. 2F where the freezer drawer is fully opened and lifted.

Lower drawer 62 can be connected to drawer front 58 and slide out track 60 with a lift arm 64, sometimes referred to as link, connected at one end by bearing post 66, sometimes referred to as a bracket pivot, to bracket 65, sometimes referred to as door bracket, connected to inner door panel 61 at mounting hole 67, and by bearing post 75, sometimes referred to as a second link pivot, to the distal end of outer slide element 74 at mounting hole 77, sometimes referred to as a door pivot. Lift arm 64 can be connected to lower drawer 62 at its opposite end at trunnion hub 68, sometimes referred to as a basket pivot, along the top edge 70 of lower drawer 62 by securing trunnion 69, sometimes referred to as the first link pivot, that can be located adjacent the opposite end of lift arm 64 in trunnion hub 68 with trunnion lock 71. A leveling bracket 72, sometimes referred to as a guide plate, can be connected at attaching points 79 to outer slide element 74 of slide 60 at attaching points 81 as shown in FIG. 2B using suitable fasteners, not shown. Leveling bracket 72 can have a leveling track 76, sometimes referred to as a guide surface, that can curve from first end 78 upward and outward to second end 80 adjacent outer slide element 74. Leveling track 76 can end in a hook shape at second end 80 to provide a positive stop. Lower drawer 62 can also have a leveling roller 82, sometimes referred to as a guide surface follower, that can be positioned at each lower rear corner of lower drawer 62 and can be arranged to engage leveling track 76 and hold lower basket in a generally horizontal position as freezer drawer 52 is moved from the closed position shown in FIG. 2A to the positions illustrated in FIGS. 2C-2F. When leveling rollers 82 reach the second end 80 of leveling track 72, leveling rollers 82 can engage the hook in leveling track 76. Lift arm 64 can be configured so that as drawer front 58 is drawn outwardly from the position in FIG. 2D, to the position in FIG. 2E, to the position in FIG. 2F, lower drawer 62 is elevated once lower drawer 62 clears upper drawer 56 (i.e. the position shown in FIG. 2D).

Figure 2D:
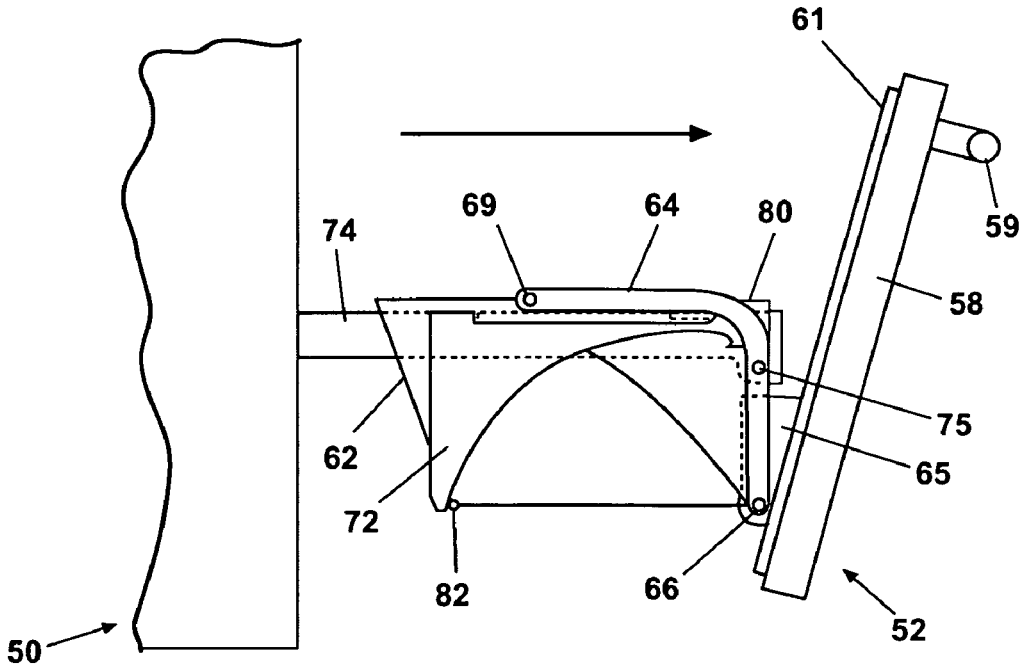
Figure 2E:
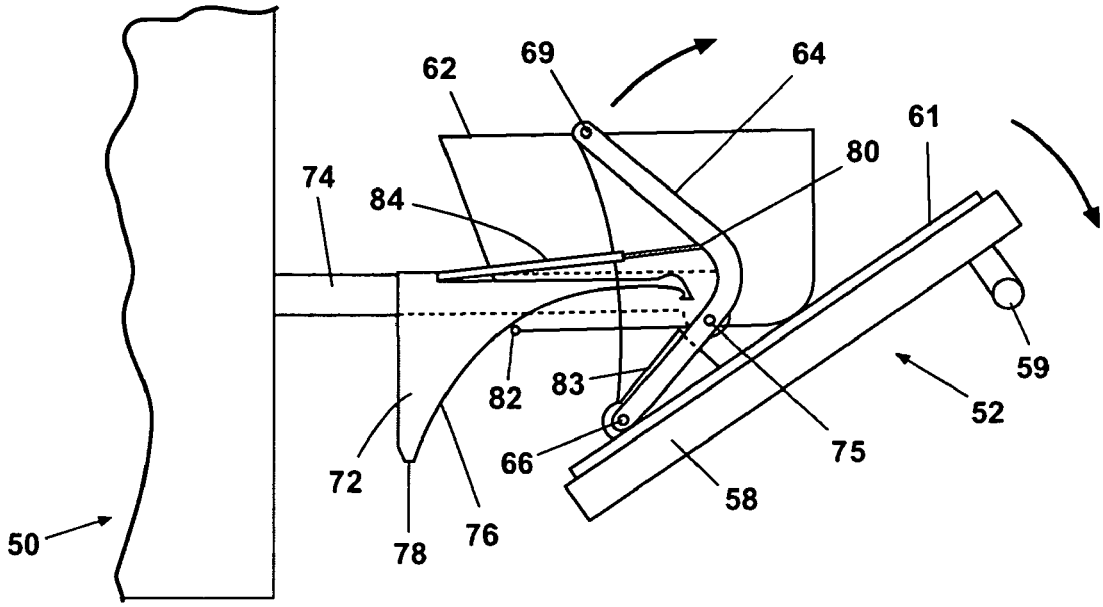
Figure 2F:
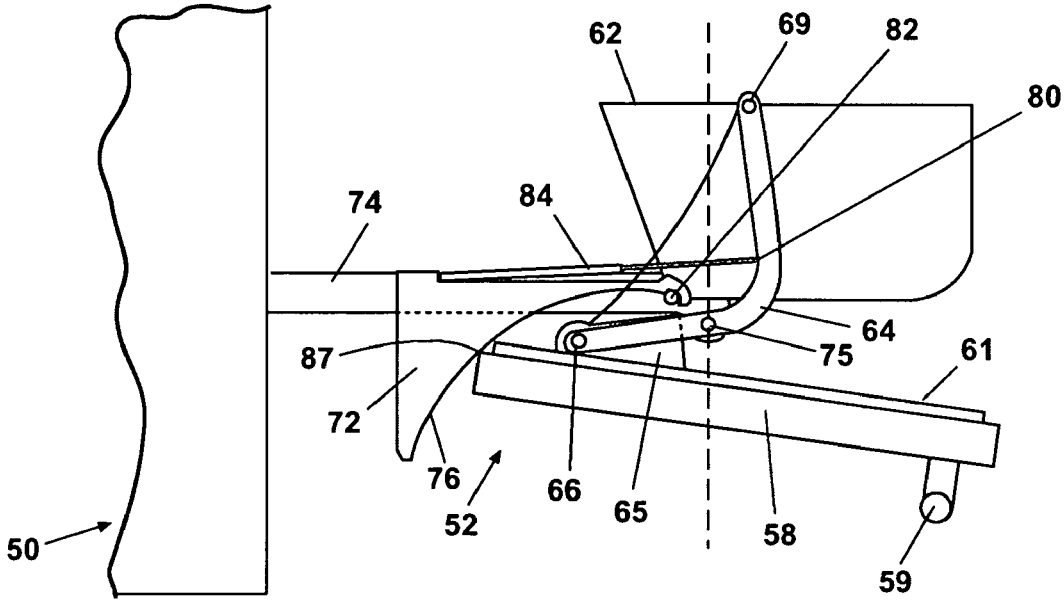

An adjustable dashpot 84 can be provided to slow rotation of the lower drawer 62 when the freezer drawer is partially loaded or unloaded. Adjustable dashpot 84 can be connected to lift arm 64 at attaching point 85 (see FIG. 2B) and to leveling bracket 76 and outer slide 74 at attaching point 79 using suitable fasteners, not shown. Thus, as freezer drawer 52 is withdrawn from freezer compartment 54, drawer front 58 can pivot from the position in FIG. 2A to the position in FIG. 2C where lift arm 64 can engage stop flange 83 that can be formed in drawer front bracket 65, see FIG. 2B. When lift arm 64 engages stop flange 83 continued force applied to drawer front 58 can draw lower basket 62 out of freezer compartment 54 as freezer drawer 52 is moved from the position shown in FIG. 2C to the position shown in FIG. 2D at which point outer slide 74 can be at full extension. As force is continued to be applied to drawer front 58 stop flange 83 begins to rotate lift arm 64 causing lift arm 64 to continue moving lower drawer 62 forward and upward as lift arm 64 lifts trunnion hub 68 and leveling rollers 82 begin to move up leveling tracks 76, see FIG. 2E. As force is continued to be applied to drawer front 58, drawer front 58 continues to rotate downward lifting lower drawer 62 and drawing lower drawer 62 outward to the position shown in FIG. 2F. At the position shown in FIG. 2F leveling roller has engaged the hook in leveling track 76 at second end 80 and the lower edge of drawer front 58 contacts the leveling bracket at contact point 87 as shown in FIG. 2F. At the point illustrated in FIG. 2F, lower drawer is fully withdrawn and raised to place the lower drawer at a higher level to place the lower drawer and its contents in a better ergonomic position for removal of contents or adding contents to the lower freezer drawer. As can be seen be referring to FIG. 2F, when freezer drawer 52 is fully open, drawer front 58 can be tucked out of the user's way under lower drawer 62. This can allow users to position themselves up to and over lower drawer 62 for easy food removal. This arrangement can present good ergonomic position for the user as the user's feet can be under the drawer front 58.

The weight of drawer front 58 can act as a full or partial counterweight to the weight of lower drawer 62 and its contents. As noted above, adjustable dashpot 84 can help slow and smooth the motion of lower freezer drawer from the open position (FIG. 2F) to the lowered position (FIG. 2D). In addition, freezer drawer 52 can be provided with a rack and pinion stabilizer system, not shown, that can help keep freezer drawer 52 moving smoothly and uniformly into and out of freezer compartment 54. A rack and pinion stabilizer system for freezer drawer 52 can be similar to the rack and pinion stabilizer system disclosed in U.S. Pat. No. 7,430,937 or to the rack and pinion system disclosed in co-pending U.S. patent application Ser. No. 11/838,978 which are both incorporated by reference in their entirety in this application.

Figure 3B:
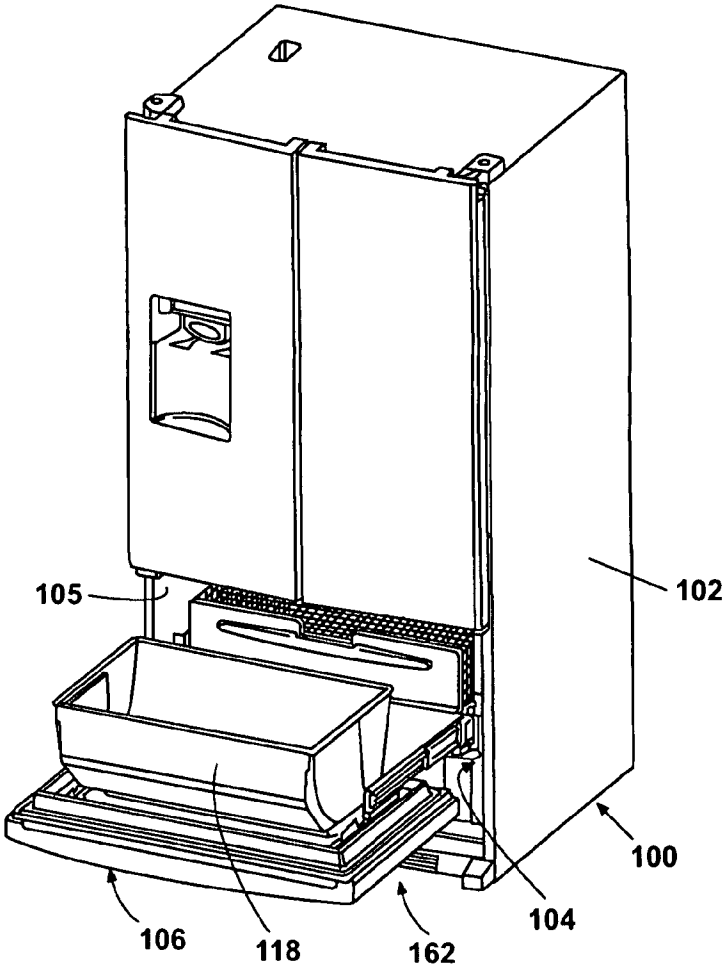
FIG. 3B is a perspective view of the refrigerator freezer of FIG. 3A showing the freezer drawer fully open with the food storage basket elevated to an upper position.
Figure 3A:
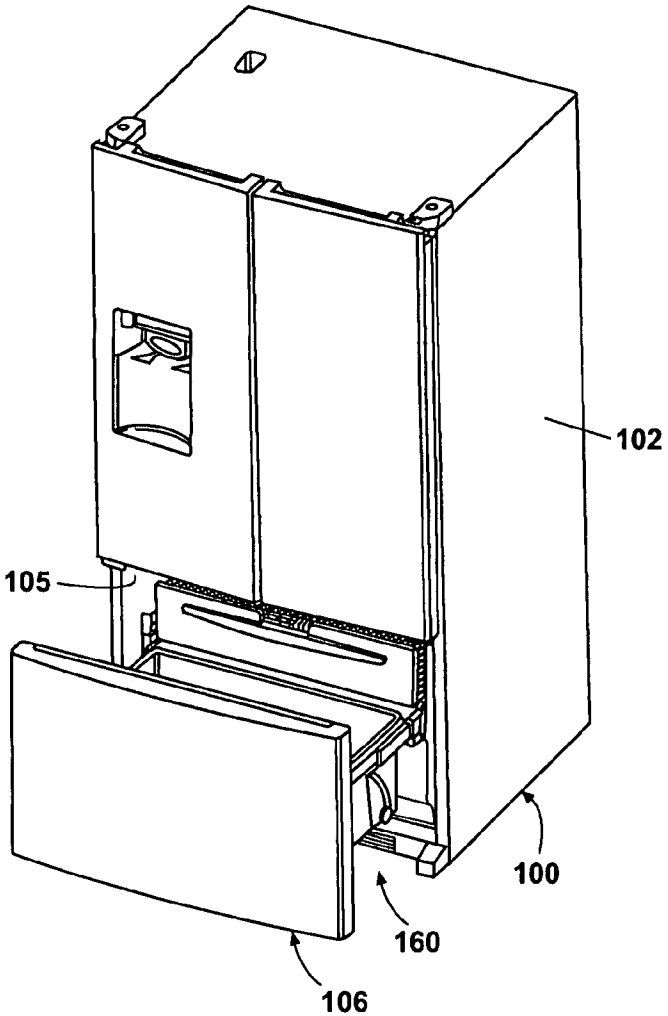
FIG. 3A is a perspective view of another embodiment of a bottom mount refrigerator freezer showing a freezer drawer in a partially open position.
Figure 5A:
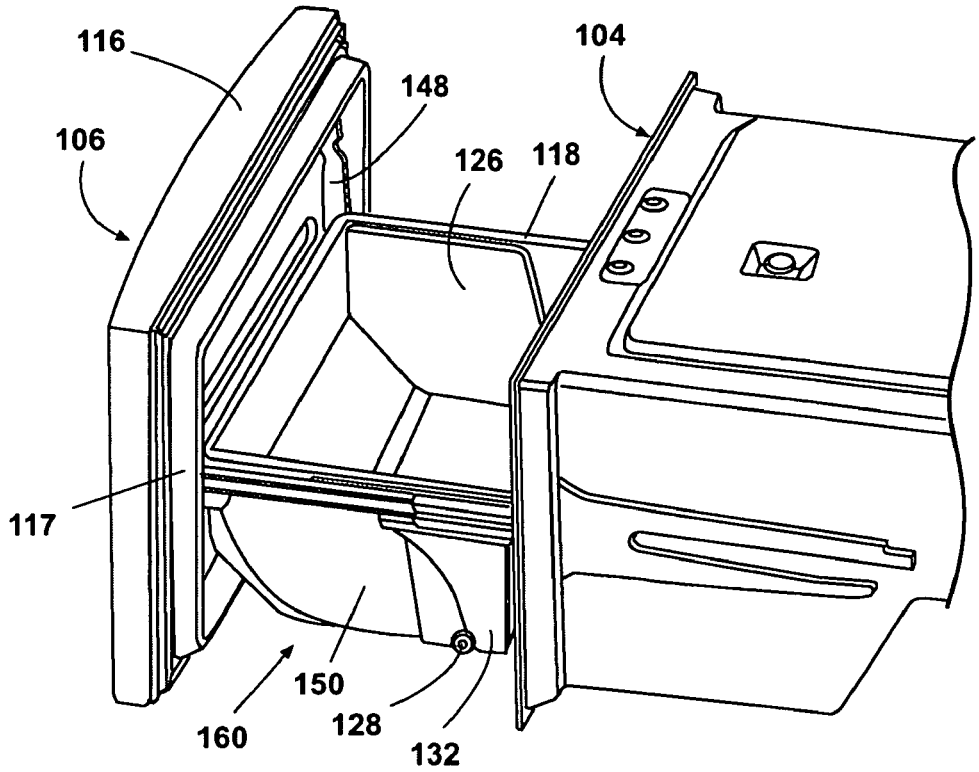
FIGS. 5A and 5B are partial side views of the freezer drawer of FIGS. 3A and 3B illustrating the support mechanism.
Figure 5B:
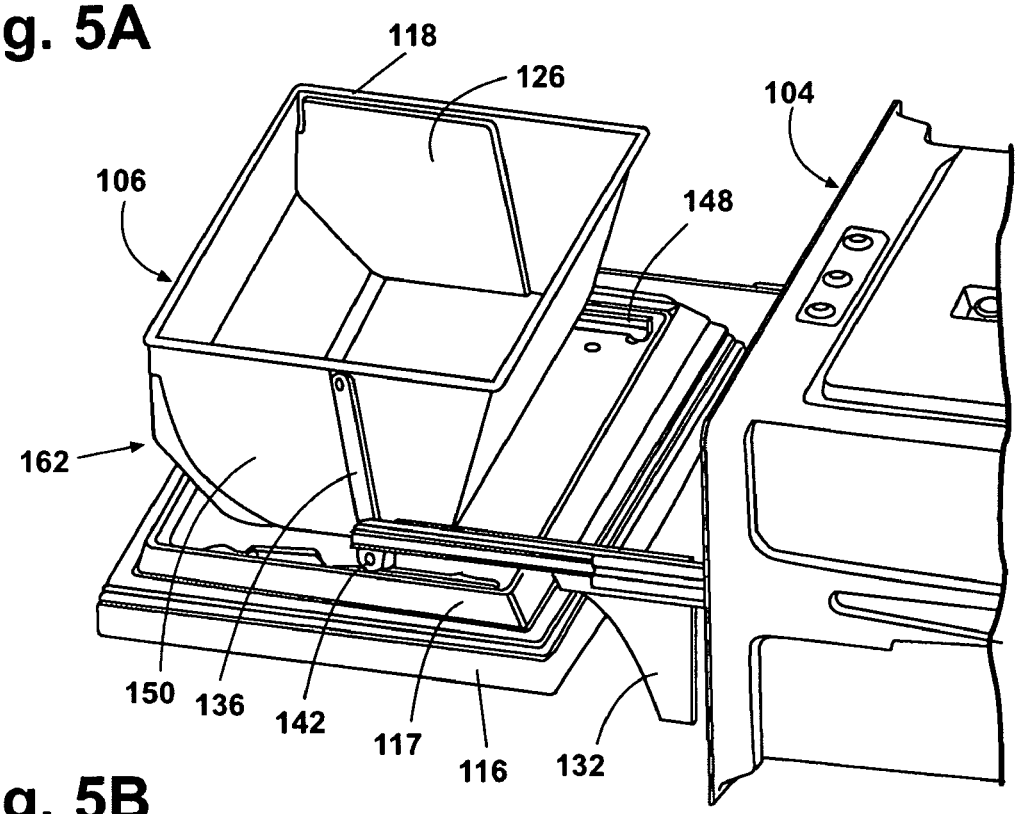

Turning to FIGS. 3A-3C and 5A and 5B another embodiment of a freezer drawer for a bottom mount freezer refrigerator can be seen. Bottom mount refrigerator freezer 100 can have a refrigerator compartment above freezer compartment 104 as illustrated in FIGS. 3A and 3B. The refrigerator compartment can have one insulated door, or as illustrated in FIGS. 3A and 3*b*, two insulated doors. Bottom mount freezer refrigerator 100 can have a conventional bottom mount refrigeration system, not shown, as are well known in the art. Bottom mount refrigerator freezer 100 can have a slide out drawer 106 that can be arranged for movement into and out of insulated freezer compartment 104 in insulated cabinet 102. Slide out drawer 106 can have an insulated compartment door 116, sometimes referred to as a drawer front. Slide out drawer 106 can include a first food storage basket 118 that can be carried by a support mechanism 130 to allow the food storage basket 118 to move between a lower position 160, as seen in FIGS. 3A and 5A to an upper position 162 as seen in FIGS. 3B and 5B to facilitate user access to the food stored in food storage basket 118. The food storage basket 118 shown in this embodiment is illustrated having solid walls that can be molded plastic or formed sheet metal. Food storage basket 118 can have a front wall 122, side walls 119, rear wall 123 and bottom wall 124. Those skilled in the art will understand that food storage basket 118 can alternately be a wire basket as are well known in the art. In this embodiment, for example, the food storage basket 118 and the support mechanism 130 can be arranged to provide for the food storage basket 118 to be lifted 7.5 inches in moving from the lower position 160 to the upper position 162, although those skilled in the art will understand that the vertical lift of food storage basket 118 can be modified as desired to be greater or less than the 7.5 inches in this example. As in the previous embodiments, the insulated compartment door or drawer front 116 can be pivotally mounted to the support mechanism 130 so that as drawer front 116 is pivoted down from the position shown in FIG. 3A to the position shown in FIG. 3B. The support mechanism 130 can lift food storage basket 118 upward and outward from the lower position 160 shown in FIGS. 3A and 5A to the upper position 162 shown in FIGS. 3B and 5B.

Figure 3C:
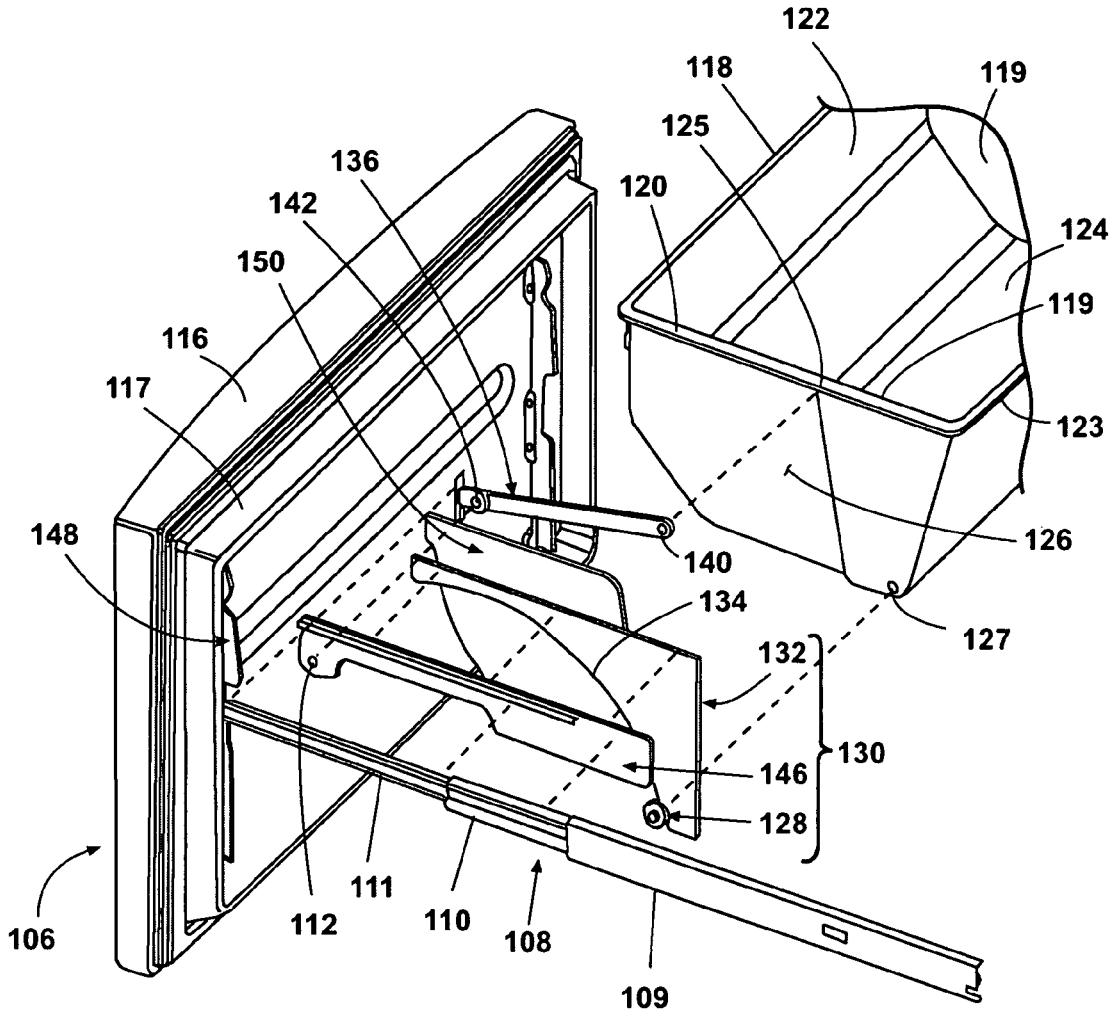
FIG. 3C is a partial exploded side view of the freezer drawer of refrigerator freezer of FIG. 3A illustrating the support mechanism for the food storage basket.

As can be readily seen in FIG. 3C, support mechanism 130 can include a conventional triple slide track 108 for each side of the slide out drawer 106 that can include a fixed slide 109 that can be attached to a sidewall 105 in freezer compartment 104, a second movable slide 110 and a third movable slide 111. A longitudinally extending bracket 146 can be attached to third movable slide 111 and can include a door pivot 112 adjacent the distal end of the third movable slide 111. A guide plate 132 can be attached to bracket 146 and can include a guide surface 134. Similar to the embodiment of FIG. 2A-2F food storage basket 118 can include a guide surface follower 127 that can include a roller 128 that can be arranged to roll along guide surface 134 as drawer front 116 is pivoted from the position shown in FIG. 3A to the position shown in FIG. 3B and food storage basket 118 is lifted from the lower position 160 to the upper position 162 to restrict tilting and lateral displacement of food storage basket 118.

Figure 4A:
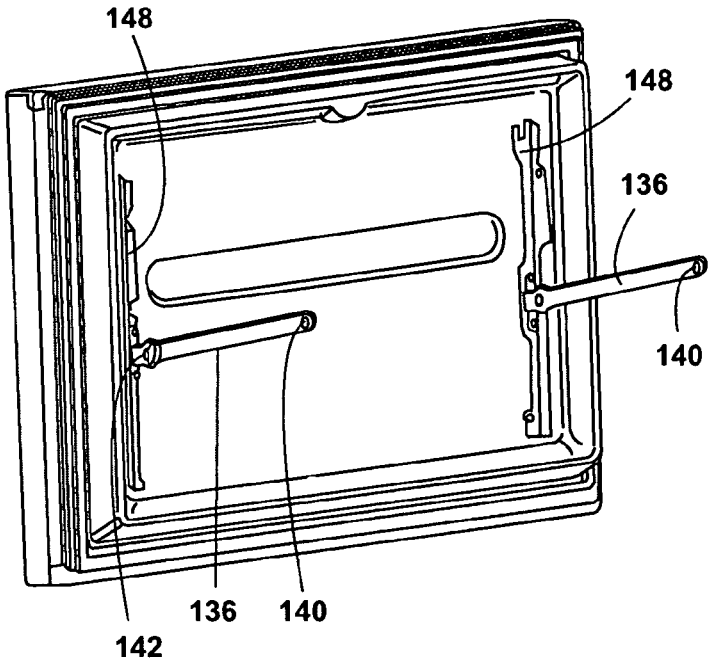
FIGS. 4A and 4B are partial views of a portion of the freezer drawer of FIG. 3A illustrating a portion of the support mechanism.
Figure 4B:
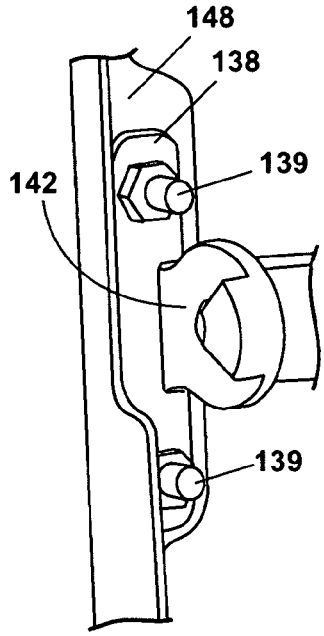

Turning to FIGS. 4A and 4B together with FIG. 3C, support mechanism 130 can also include a pair of links 136 that can have a base 138 affixed to link 136. Drawer front 116 can include an inner door liner 117 with insulation provided between the drawer front 116 and inner door liner 117 as is well known in the art. Drawer front 116 can have a pair of door plates 148 mounted to drawer front 116 on the surface of inner door liner 117. Each link 136 can be attached to a door plate 148 with a bolt and nut fastener 139 as shown in FIG. 4B. As will be understood by those skilled in the art door plates 148 can be supported on the surface of inner door liner 117 by a suitable support frame, not shown, in the insulation space under inner door liner 117. As illustrated in FIG. 4B link base 138 can be formed integrally with link 136 or can be otherwise affixed to link 136, such as by welding link base 138 to link 136. Link 136 can include a first link pivot 140 at the distal end of link 136 opposite link base 138. First link pivot 140 can be pivotally connected to basket pivot 125 on food storage basket 118. Link 136 can also have a second link pivot 142 adjacent to link base 138. Second link pivot 142 can be pivotally connected to door pivot 112 on bracket 146 to provide a pivotal connection between drawer front 116 and support mechanism 130. Thus, as drawer front 116 is pivoted downward from the position shown in FIG. 3A to the position shown in FIG. 3B, links 136 can rotate from a generally horizontal position as shown in FIGS. 3C and 4A to a generally vertical position as shown in FIG. 3B which can lift food storage basket 118 upward and outward from a lower position 160 shown in FIG. 3A to an upper position 162 shown in FIG. 3B. As food storage basket 118 is lifted upward and outward guide surface follower 127 and roller 128 can travel along guide surface 134 to restrain food storage basket 118 from tilting or lateral displacement.

Figure 4C:
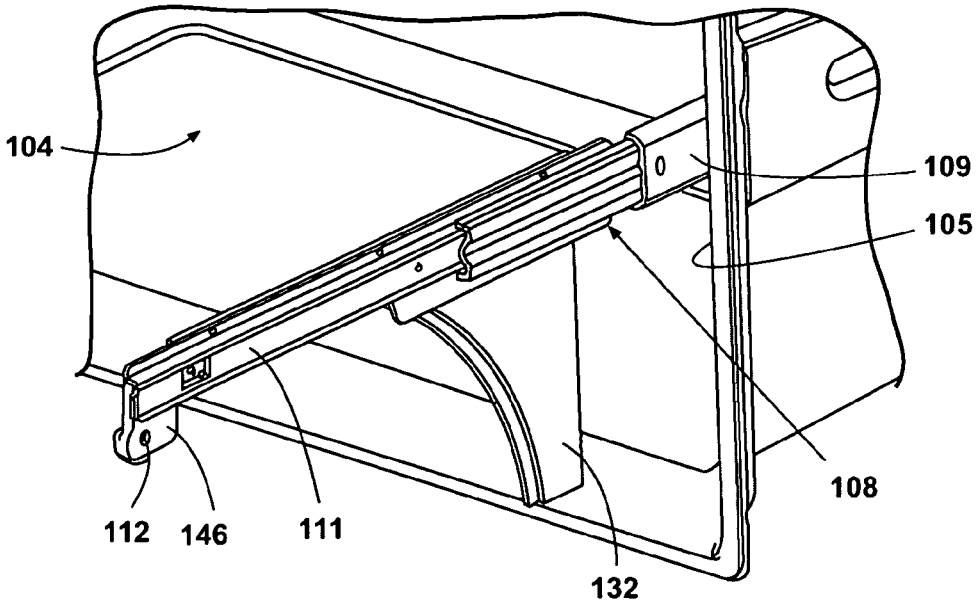
FIGS. 4C-4E are partial views of the freezer drawer and support mechanism of FIG. 3A illustrating assembly of the freezer drawer.
Figure 4D:
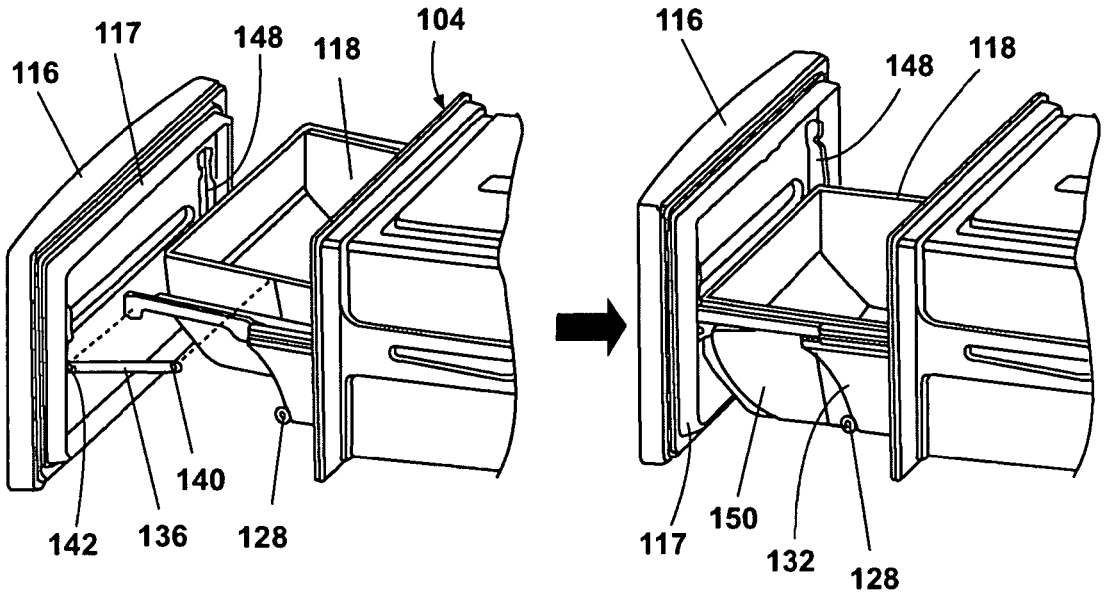
Figure 4E:
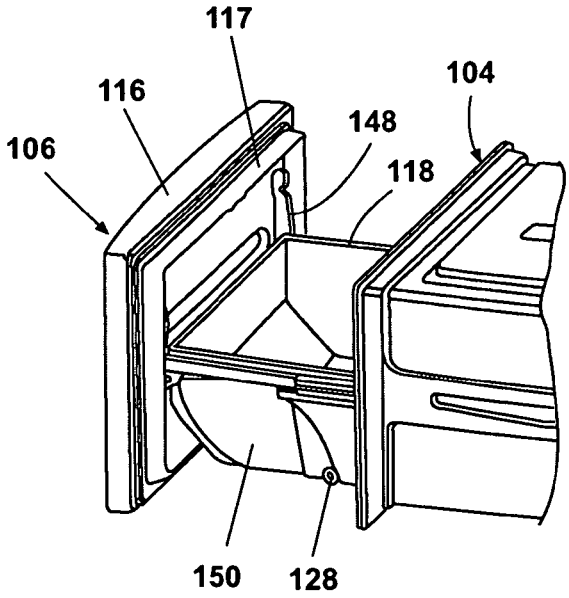

Freezer drawer 106 can be assembled by first affixing links 136 to the drawer front 116 by attaching links 136 to door plates 148 using two bolts and nuts 139 for each link as shown in FIG. 4B. Next a bracket 146 and guide plate 132 can be affixed to each movable slide out track member 111 of slide out track 108 previously attached to opposite sidewalls 105 in freezer compartment 104, see FIG. 4C. Next, second link pivots 142 can be hinged to door pivots 112 on brackets 146 using a hinge element, not shown, that can be a hinge pin or other hinge element as are well known in the art. Next, first link pivots 140 can be hinged to food basket pivots 125 with guide surface followers 127 and rollers 128 in contact with guide surfaces 134, FIG. 4D. Last, if desired, cover plates 150 can be attached to food storage basket 118 to substantially enclose links 136 to screen and restrict contact with link 136 as link 136 lifts food storage basket 118 from the lower position 160 to the upper position 162. Food storage basket 118 can include recesses 126 in sidewalls 119 to accommodate links 136 between the sidewalls 119 and cover plates 150. Freezer drawer 106 can then be moved into and out of freezer compartment 104 on slide out tracks 108, FIG. 4E. In addition, similar to the embodiments described above, freezer drawer 106 can be provided with a rack and pinion stabilizer system, not shown, that can help keep freezer drawer 106 moving smoothly and uniformly into and out of freezer compartment 104. A rack and pinion stabilizer system for freezer drawer 106 can be similar to the rack and pinion stabilizer system disclosed in U.S. Pat. No. 7,430,937 or to the rack and pinion system disclosed in co-pending U.S. patent application Ser. No. 11/838,978 which are both incorporated by reference in their entirety in this application.

Figure 7A:
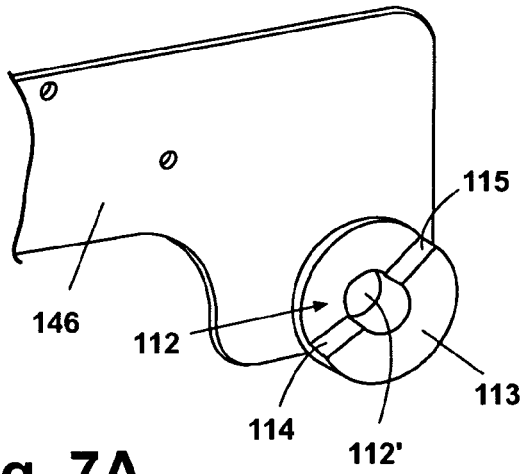
FIGS. 7A-7H are partial views of a stopper arrangement that can be used with the refrigerator freezer of FIG. 3A.
Figure 7B:
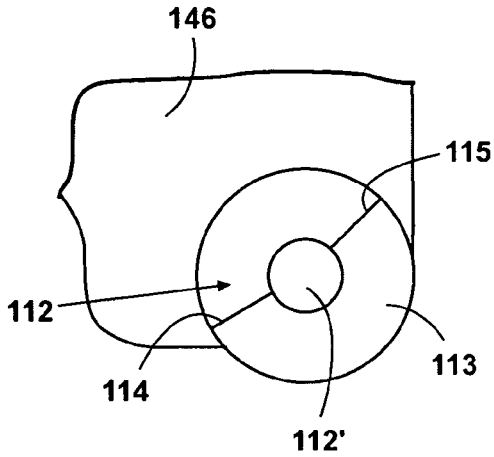
Figure 7C:
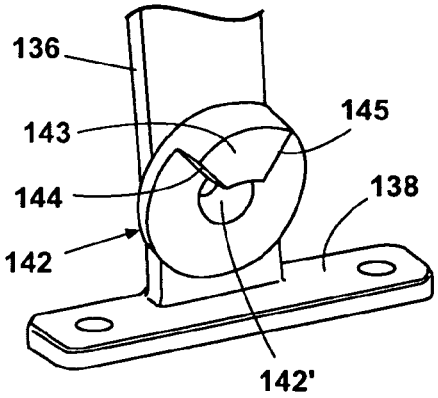
Figure 7D:
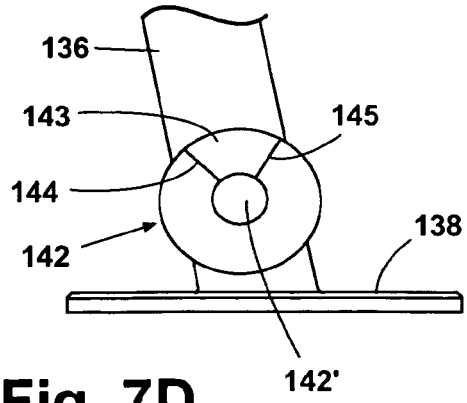
Figure 7E:
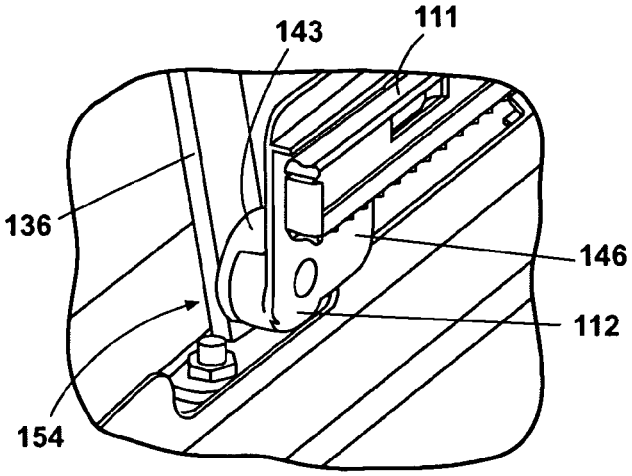
Figure 7F:
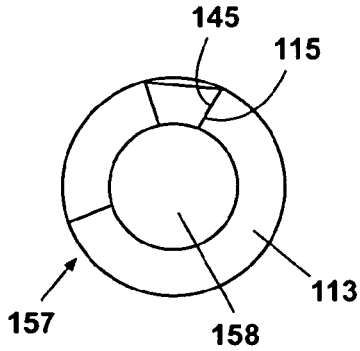
Figure 7G:
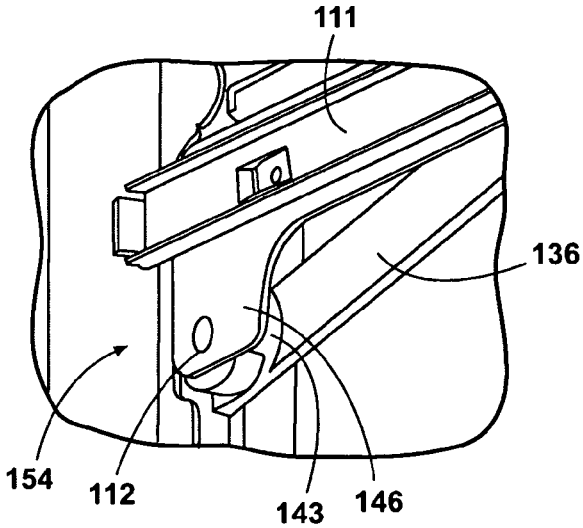
Figure 7H:
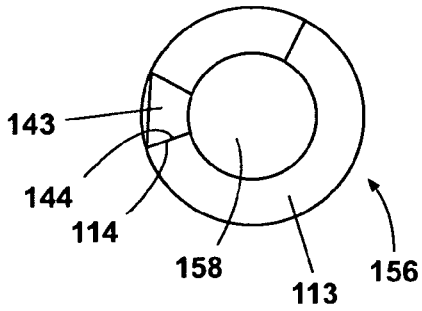
Figure 8:
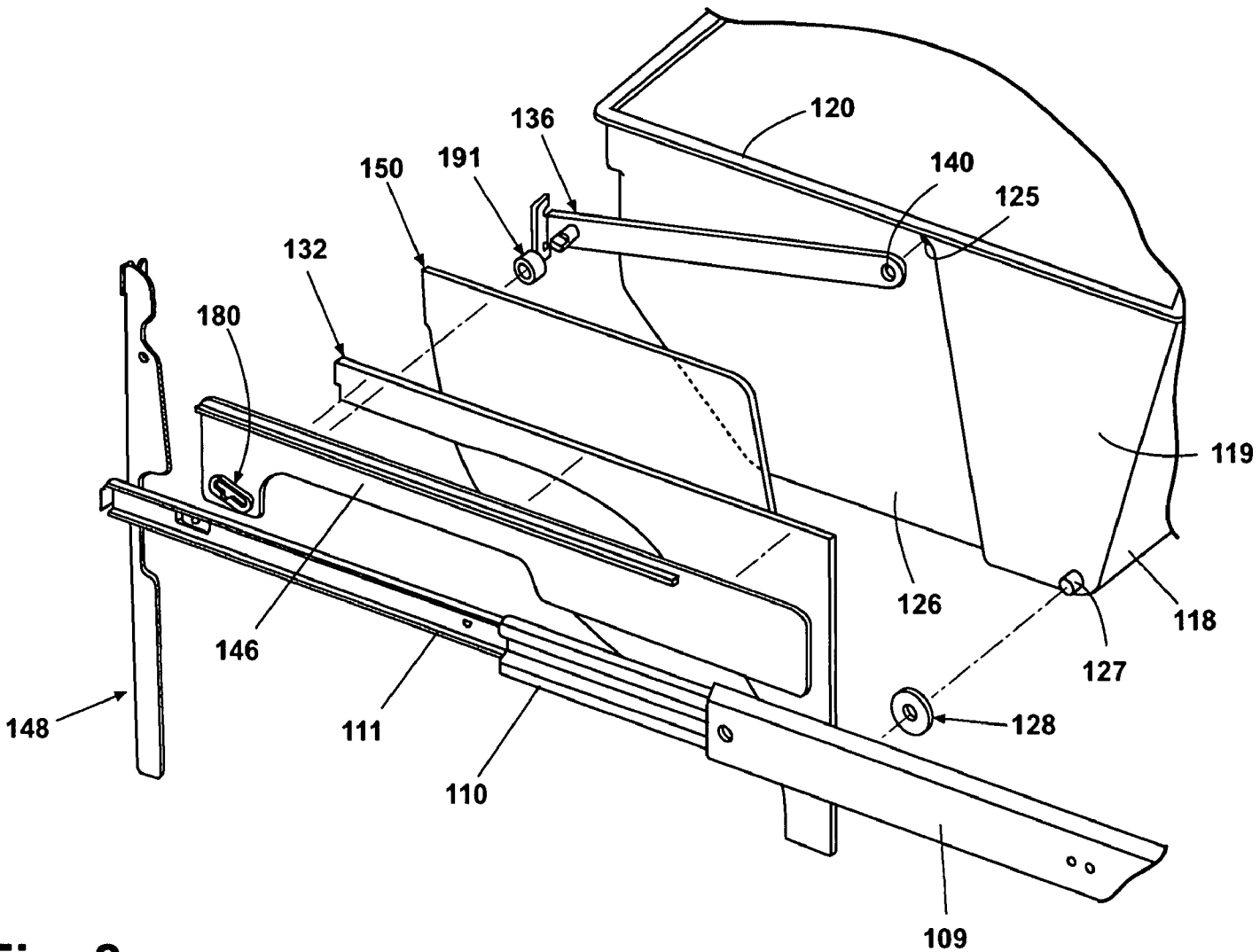
FIG. 8 is a partial exploded view of an alternate latching arrangement that can be used with the refrigerator freezer of FIG. 3A FIGS. 9A-9F are partial views illustrating elements of the alternate latching arrangement of FIG. 8.

Turning to FIGS. 7A-7H an embodiment of a stopper arrangement that can be used in combination with a freezer drawer illustrated in FIGS. 3A-3C to stop the food storage basket 118 in the lower position 160 and the upper position 162 is illustrated. Stopper 154 can include link 136 and bracket 146. Referring to FIGS. 7A and 7B, bracket 146 can have a door pivot 112 that can include a partial collar 113 forming axially extending surfaces. First stopping surface 114 and second stopping surface 115 can extend from door pivot 112 in an axial direction on opposite sides of pivot hole 112'. Referring to FIGS. 7C and 7D, link 136 can have a second link pivot 142 that can include an axially extending partial collar forming a pin 143. Pin 143 can have a first surface 144 and a second surface 145 that extend generally axially adjacent pivot hole 142'. For example, in one embodiment, first stopping surface 114 and second stopping surface 115 can define an arc of 165° and first surface 144 and second surface 145 of pin 143 can define an arc of 75°. Those skilled in the art will understand that arcs defined by the stopping surfaces can be greater or smaller than the example set forth above depending of the range of lift motion to be permitted for the freezer drawer. When food storage basket 118 is in the lower position 160, stopper 154 is in a first position 156 (see FIG. 7H) in which first stopping surface 114 of door pivot 112 can be in engagement with first surface 144 of pin 143 to restrain further counterclockwise rotation of link 136 relative to bracket 146 as seen in FIG. 7H. When food storage basket 118 is in the upper position 162 stopper 154 is in a second position 157 (see FIG. 7F) in which second stopping surface 115 can be in engagement with second surface 145 to restrain further clockwise rotation of link 136 relative to bracket 146 as seen in FIG. 7F. Also, hinge pin 158 is shown schematically in FIGS. 7F and 7H. Thus, a stopper 154 can be provided to restrain or limit rotational movement of support mechanism 130 so that food storage basket is restrained to motion between a lower position 160 and an upper position 162 as illustrated in FIGS. 5A and 5B as noted above.

Figure 6A:
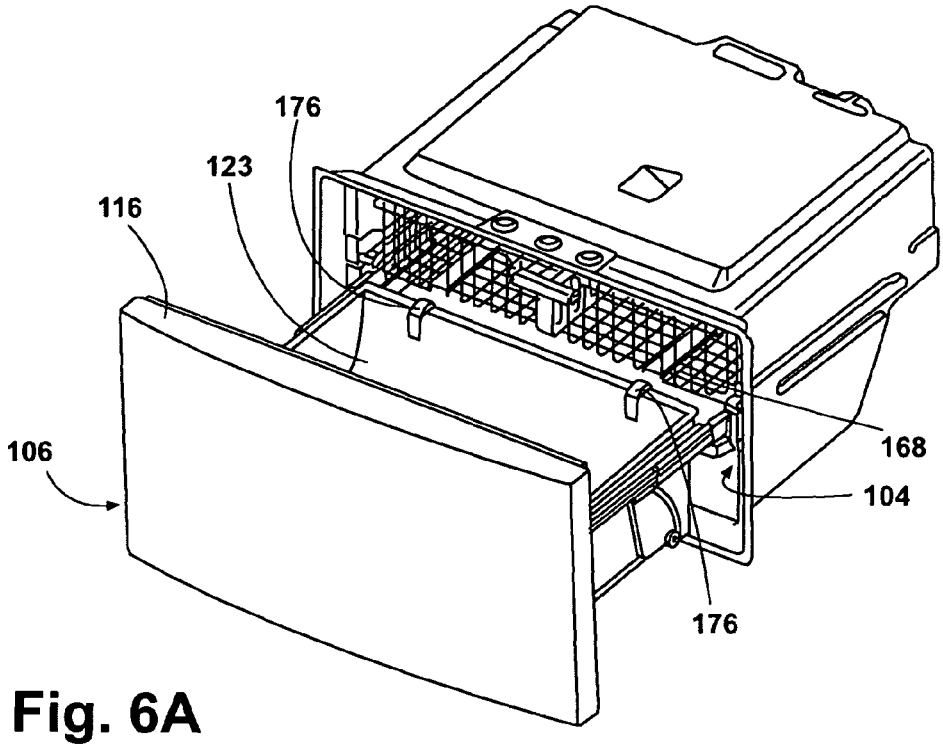
FIG. 6A is a partial perspective view of a modified embodiment of the bottom mount refrigerator freezer of FIG. 3A illustrating a latching mechanism.
Figure 6B:
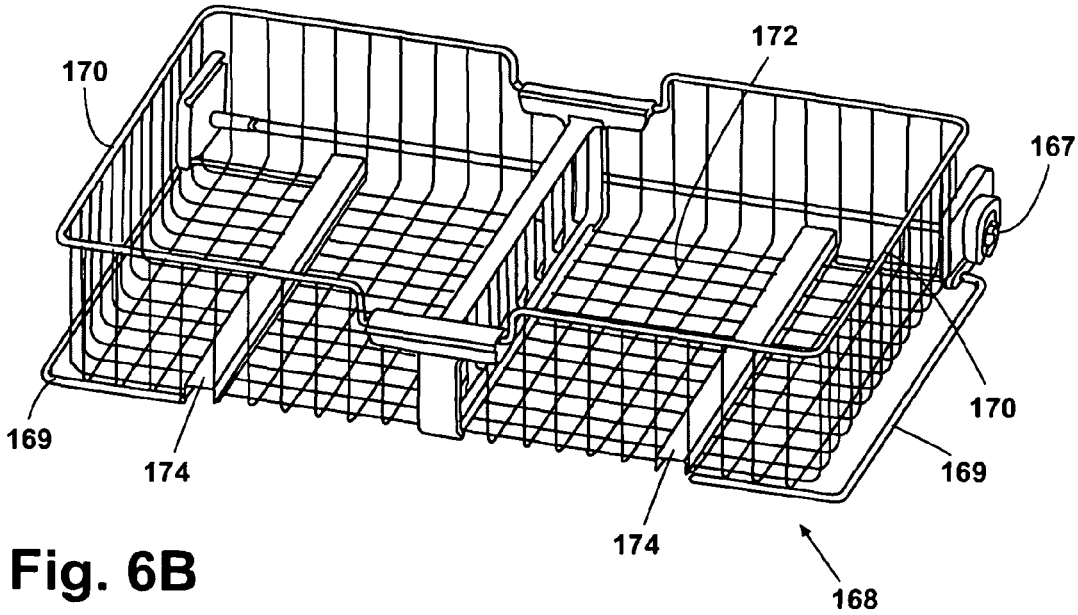
FIG. 6B is a perspective view of a second food storage basket of the refrigerator freezer of FIG. 6A.
Figure 6C:
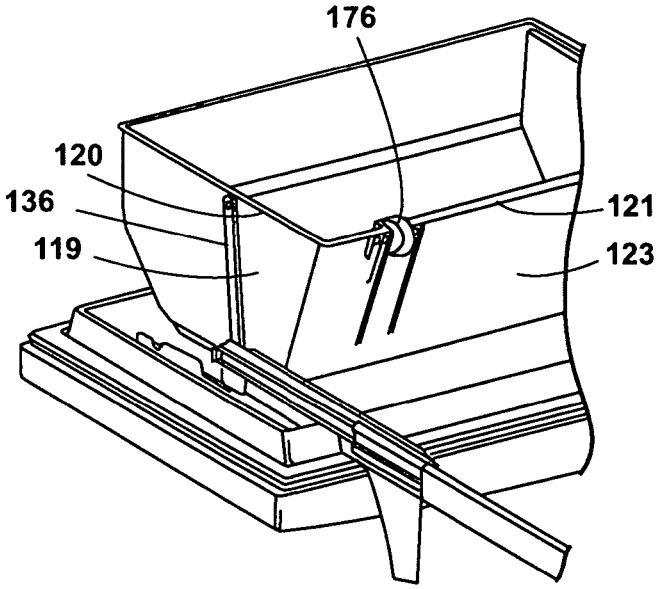
FIGS. 6C and 6D are partial views illustrating elements of the latching mechanism of the refrigerator freezer of FIG. 6A.
Figure 6D:
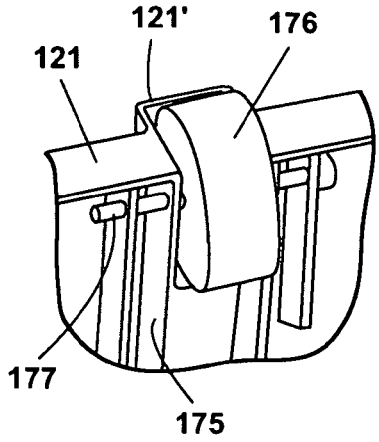
Figure 6E:
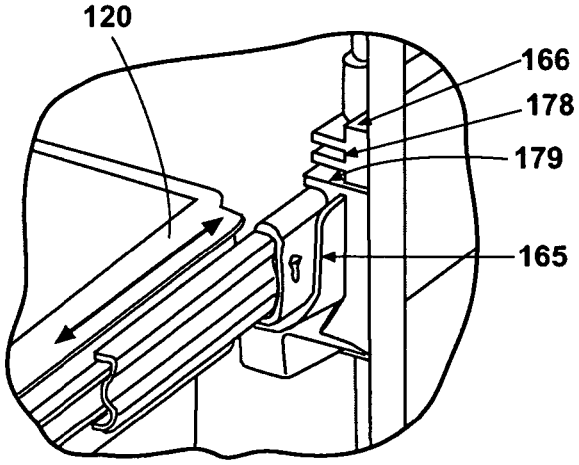
FIGS. 6E-6H are partial views illustrating an alternate latching mechanism for the bottom mount refrigerator freezer of FIG. 3A.
Figure 6F:
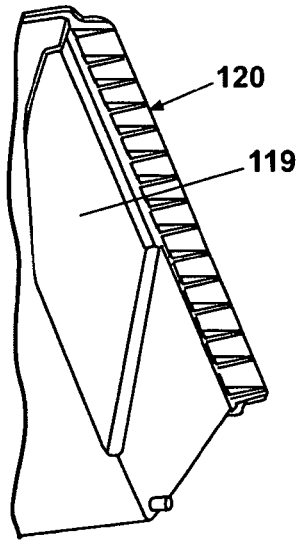

Turning to FIGS. 6A-6D an embodiment of a passive latching mechanism that can be used in combination with a freezer drawer illustrated in FIGS. 3A-3C to restrict rotation of the insulated compartment door 116 until the drawer is opened a desired amount is illustrated. This embodiment can be considered to be a passive latching mechanism because the latching mechanism can depend only on the position of the freezer drawer and can function without any user intervention other than opening the freezer compartment door 116. To avoid drawer front 116 from pivoting on door pivots 112 before first food storage basket 118 has been withdrawn from freezer compartment 104, it can be advantageous to include a latching arrangement to assure that first food storage basket 118 is clear of freezer compartment 104 before drawer front 116 can be pivoted downward as described above. As illustrated in FIGS. 6A and 6B freezer compartment 104 can have a second food storage basket 168 slideably mounted in freezer compartment 104 above first food storage basket 118. Second food storage basket 168 can have sidewalls 170, a bottom wall 172 and a pair of slides 169 that can slide in first slot 178 above spacer 164. Fixed slide 109 can be attached to adapter plate 165 to mount the fixed slide 109 to sidewall 105 of insulated cabinet 102. The lower surface of slot 178 can be formed by the upper surface of adapter plate 165 and spacer 164. The upper surface of slot 178 can be formed by rack 166 that can be arranged to engage pinion 167 carried on second food storage basket 168. The rack 166 and pinion 167 can be a rack and pinion stabilizer system such as described in U.S. Pat. No. 7,430,937 or co-pending U.S. patent application Ser. No. 11/838,978 both referred to above and incorporated by reference in this application. Second food storage basket 168 can have a bottom wall 172 that can have a pair of downwardly opening recessed channels 174 positioned parallel to slides 169. First food storage basket 118 can have a pair of wheels 176 that can be rotatably mounted adjacent the top of rear wall 123 and positioned to engage downwardly opening recessed channels 174 when the first food storage basket 118 is positioned beneath the second food storage basket 168 when freezer drawer 106 is not in the fully withdrawn position illustrated in FIG. 6A. As illustrated in FIG. 6D, rear wall 123 can have one or more ribs 175 that can support an axle 177 to rotatably support wheels 176 adjacent the top of rear wall 123 in notches 121' in rear wall flange 121. So long as wheels 176 engage recessed channels 174 first food storage basket 118 is restrained from rotating from the lower position 160 toward the upper position 162 and rotation of drawer front 116 can be restricted. When freezer drawer 106 opens to the point where wheels 176 no longer engage downwardly opening recesses 174 drawer front 116 can pivot on door pivots 112. As drawer front 116 pivots on door pivots 112 links 136 can lift first food storage basket 118 from the lower position 160 to the upper position 162.

Figure 6G:
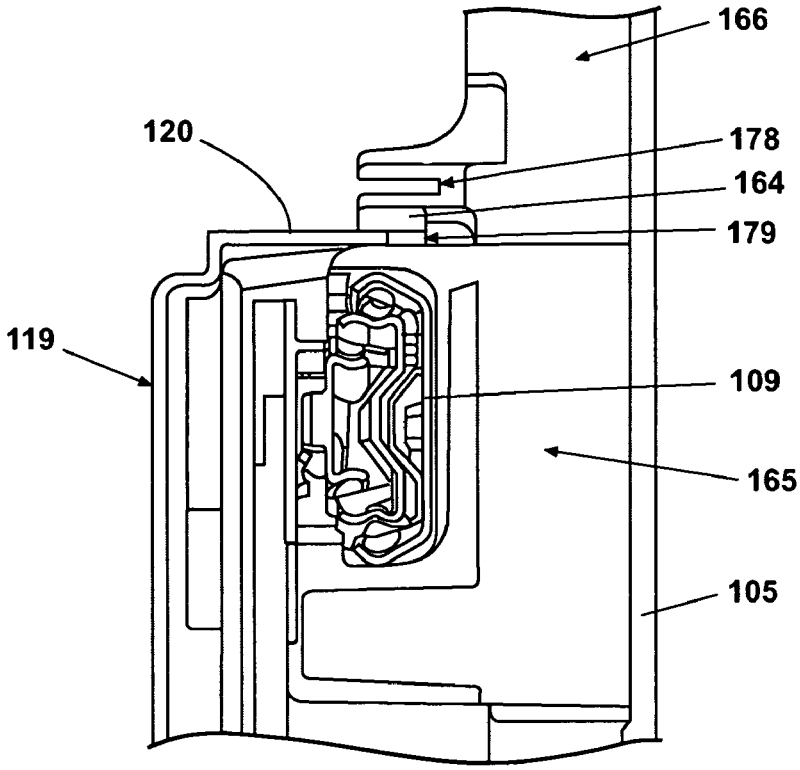

Turning to FIGS. 6E-6H, another embodiment of a passive latching mechanism that can be used in combination with a freezer compartment drawer illustrated in FIGS. 3A-3C is illustrated. In this embodiment adapter plate 165 can be arranged to include a second slot 179 that can be formed in adapter plate 165 and can include spacer 164 (see FIGS. 6G and 6H). In this embodiment the sidewalls 119 of first food storage basket 118 can have an outwardly directed flange 120 that can be arranged to engage slot 179 (as illustrated in FIG. 6G) when freezer drawer 106 is not in the fully withdrawn position illustrated in FIG. 6A. As with the embodiment described above in FIGS. 6A-6D, so long as flanges 120 engage slots 179 first storage basket 118 can be restrained from rotating from the lower position 160 toward the upper position 162 and rotation of drawer front 116 can be restrained. When freezer drawer 106 opens to the point where flanges 120 no longer engage slots 179 drawer front 116 can pivot on door pivots 112. As drawer front 116 pivots on door pivots 112 links 136 can lift first food storage basket 118 from the lower position 160 to the upper position 162.

Figure 6H:
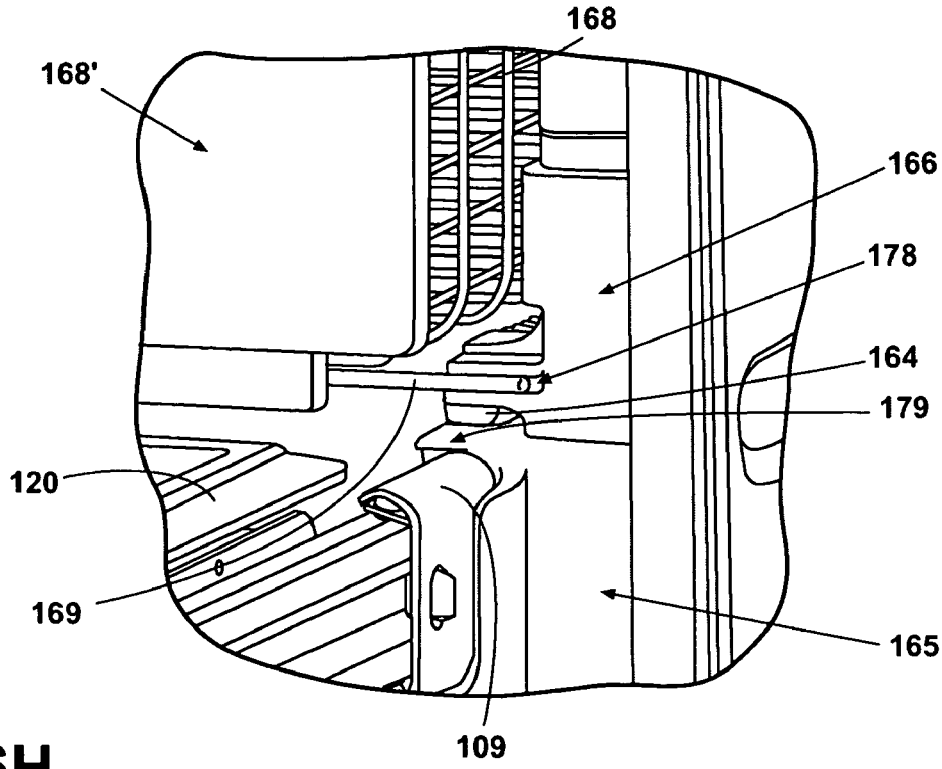

The latching mechanisms of FIGS. 6A-6D and FIGS. 6E-6H can be separately utilized as described above, or, if desired, can be used in combination to restrain rotation of drawer front 116 until food basket 118 has opened sufficiently to begin unobstructed rotation and elevation from the lower position 160 to the upper position 162. Those skilled in the art will understand that first slot 178 and second slot 179 can be provided by other structural elements than the adapter plate 165 and rack 166 as described above. As shown in FIG. 6H, second food storage basket 168 can include a solid front wall 168' that can be formed of plastic or metal to preclude small items from sliding out of the second food storage basket 168 or for aesthetic design considerations.

Figure 9C:
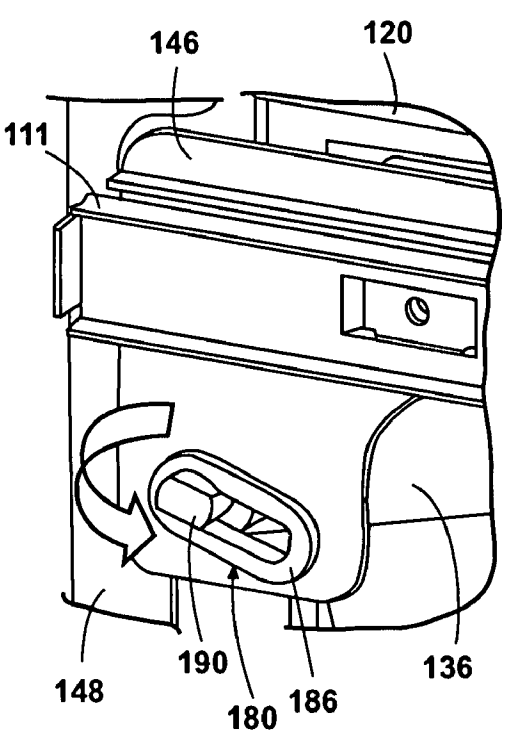
Figure 9B:
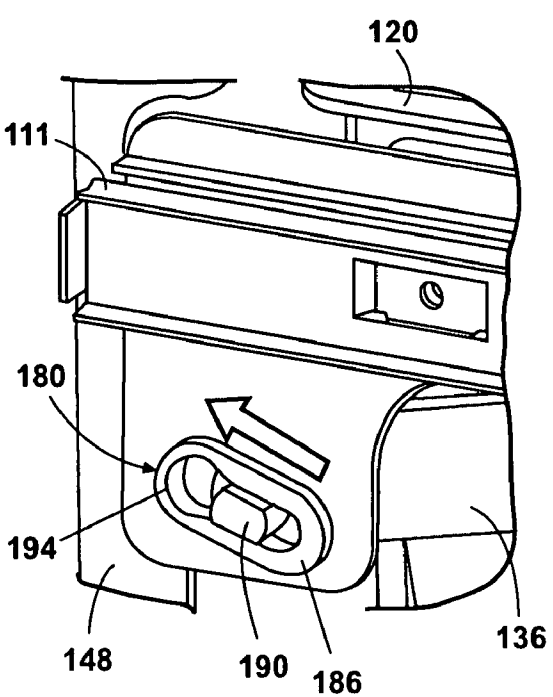
Figure 9A:
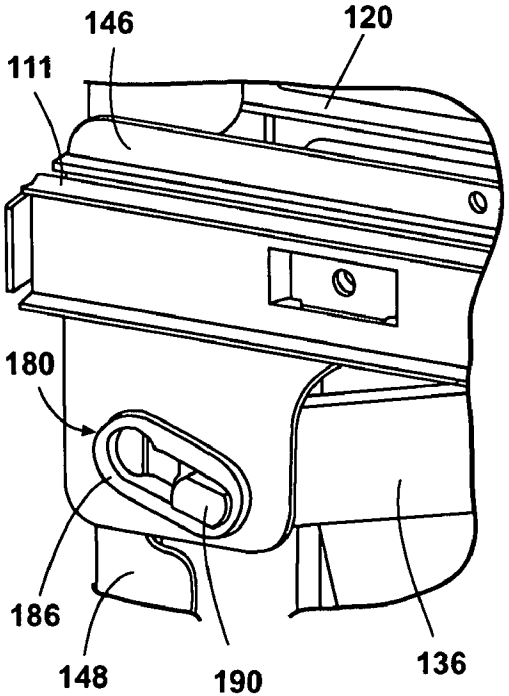
Figure 9D:
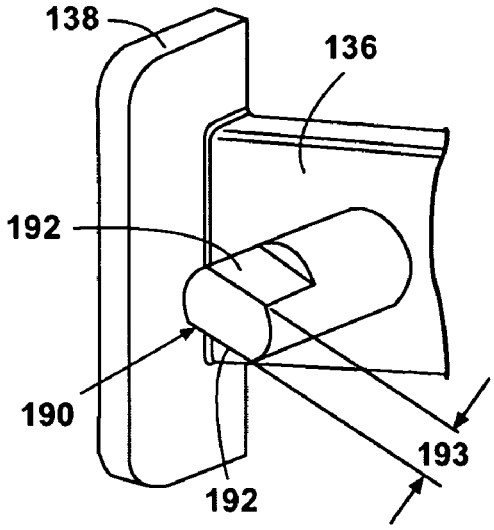
Figure 9E:
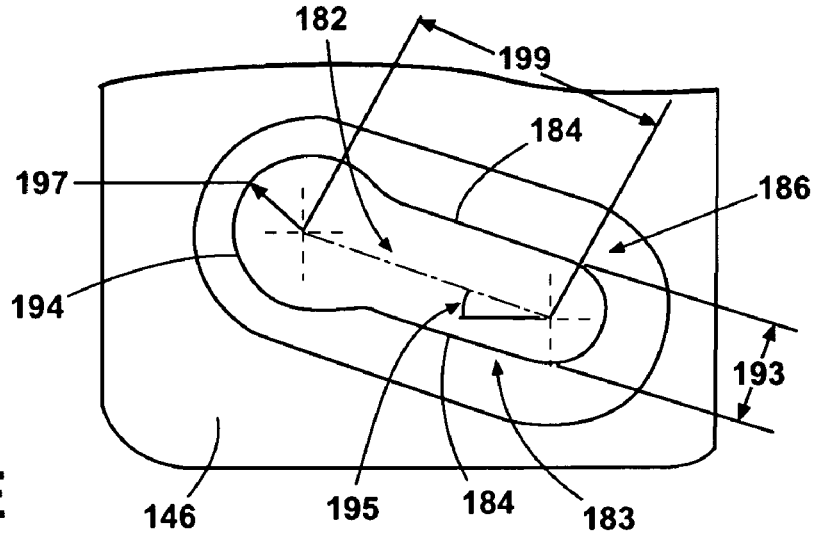
Figure 9F:
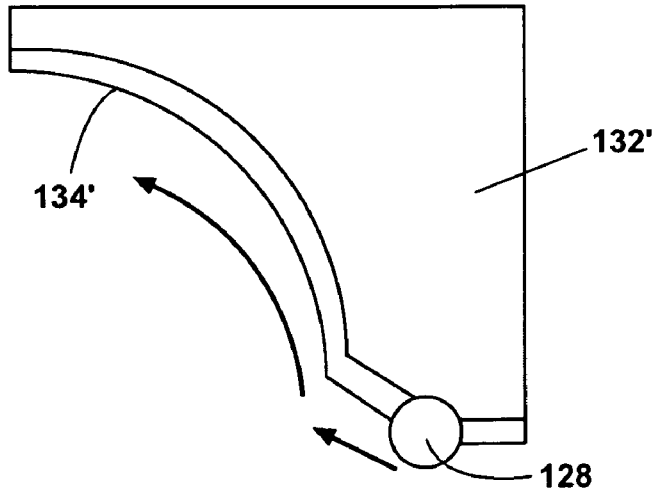

Turning to FIG. 8 and FIGS. 9A-9F another embodiment of a passive latching mechanism to restrain rotation of the insulated compartment door or drawer front 116 can be seen. In this embodiment door or drawer front 116 can be restrained from rotating on the door pivots 112 until the drawer 106 is fully withdrawn. As can be seen in FIG. 8 and FIGS. 9A-9F, door pivot 112 on bracket 146 in the embodiment illustrated in FIGS. 3 and 4 is replaced with a door pivot 180 comprising a generally keyhole shaped slot 182 that can be formed by a boss 186 pressed into a keyhole shaped slot in bracket 146 to provide a durable wearing surface. Boss 186 can be formed of medium carbon steel with case hardening such as EN8. Link 136 can also be modified to replace second link pivot 142 with a pivot pin 190. Pivot pin 190 can have a generally cylindrical portion at the end attached to link 136 and a flattened portion having parallel flat surfaces 192 spaced apart a distance 193. A washer 191 can be provided to position bracket 146 with parallel flat surfaces 192 engaging the generally keyhole shaped slot 182 in boss 186. Generally keyhole shaped slot 182 can have a first portion 183 with parallel walls 184 and a rounded portion 194. The spacing 193 of parallel walls 184 can be the same as the spacing 193 of parallel flat surfaces 192 and the radius 197 of rounded portion 194 can be the same as the radius of pin 190 to assure that pin 190 can rotate in generally keyhole shaped slot 182 when pin 190 is fully positioned in rounded portion 194 and slide in generally keyhole shaped slot 182 when parallel walls 192 of pin 190 are in first portion 183 engaging parallel walls 184. Further, the angle of parallel flat surfaces 192 can correspond to the angle 195 of generally keyhole shaped slot 182 along bracket 146. In one embodiment, the diameter of pivot pin 190 can be 10 mm, the spacing 193 of parallel walls 184 and parallel flat surfaces 192 can be 7 mm, the distance between the center of the rounded portion 194 to the center of pin 190 in the fully right hand position (as shown in FIG. 9E) can be 16 mm and angle 195 can be 18°. Those skilled in the art will understand than other dimensions and angles can be used as desired for this latching arrangement. In operation, as drawer 106 is opened (beginning in the position illustrated in FIG. 9A) and slide out track 108 reaches full extension movable slide 111, and accordingly bracket 146, stop. As the user continues to pull drawer 106 open (typically using a drawer handle not shown) drawer front 116, door plate 148 and link 136 continue to move outward as illustrated in FIG. 9B. When pin 190 reaches the rounded portion 194 of keyhole slot 182 pin 190 can rotate in keyhole slot 182 and drawer front 116 can rotate downward causing link 136 and can lift first food storage basket 118 from the lower position 160 to the upper position 162 as described above. Thus, drawer front 116 can be latched in an upright position until drawer 106 is fully opened to assure that food storage basket 118 is not lifted until drawer 106 is fully opened. In the embodiment illustrated in FIG. 8 and FIGS. 9A-9F, a modified guide plate 132' can be used having a guide surface 134' that can be modified to account for the relative movement of the slide out track 108, bracket and guide plate 132' when pin 190 moves in slot 182 as drawer 106 reaches its fully open position, i.e. from the FIG. 9A position to the FIG. 9C position in order for roller 128 to remain in contact with guide plate 132'.

Those skilled in the art will understand that instead of the passive latching mechanisms described above in connection with FIGS. 6A-6D, FIGS. 6E-6H and FIG. 8 and FIGS. 9A-9F an active latching mechanism, not shown, in which the user can release a latch mechanism to allow drawer front 116 to begin rotation can be employed. Such an active latch mechanism could be similar to the latch mechanism used on dishwasher doors for example. The latch mechanism, not shown, could have a user actuated button either located on the top of the inner door panel 117 or on the top front of the food basket 118.

The embodiments described above, including the embodiment illustrated in FIGS. 3A-3C, FIGS. 4A-4E and 5A-5B can have a damping mechanism and/or a spring mechanism to aid in lifting food storage basket 118 from the lower position to the upper position, and/or to decrease the speed during closing from the upper position to the lower position. Alternatives can include a rotation damping mechanism at the hinge between door pivot 112 and second link pivot 142 or a rotation spring and damping mechanism at the hinge between door pivot 112 and second link pivot 142, the spring to aid in lifting the basket and the damping to decrease speed during closing. Those skilled in the art will understand that other well known damping and/or spring biasing mechanisms can also be used, including but not limited to a dashpot similar to the dashpot illustrated in FIG. 2B or a gas strut that can be similar to gas struts employed to assist users in operating vehicle tailgates and the like.

While the invention has been specifically described in connection with certain specific embodiments thereof, it is to be understood that this is by way of illustration and not of limitation, and the scope of the appended claims should be construed as broadly as the prior art will permit.

We claim:

1. A refrigerator having at least one insulated compartment, comprising:

a pair of fixed slides attached to opposite side walls of the inner surface of the at least one compartment;

a pair of movable slides combined with the fixed slides to be movable forward and back with respect to the fixed slides and having a distal end;

a door pivot connected to each of the movable slides adjacent the distal end;

an insulated compartment door pivotally mounted to the door pivots for movement with the movable slides between a closed position closing the insulated compartment and an open position;

a food storage basket having opposite side walls with a basket pivot and a guide surface follower on each of the opposite side walls; and a support mechanism for mounting the food storage basket for movement with the compartment door and movable slides and for moving the food storage basket upward when the door is moved to the open position comprising:

a guide plate mounted to each of the movable slides and having a guide surface arranged to be engaged by a food storage basket guide surface follower;

a pair of links mounted to the insulated compartment door at one end and having a distal end, each link positioned on the insulated compartment door to be adjacent one of the food storage basket opposite side walls and having a first link pivot at the distal end to pivotally connect to a food storage basket pivot, wherein each of the links further includes a second link pivot arranged to pivotally connect to the door pivots to pivotally connect the insulated compartment door to the movable slides.

2. The refrigerator as claimed in claim 1, wherein the guide surface followers comprise a roller arranged to roll along the guide surface to maintain the food basket in a generally upright orientation as the food storage basket is moved upward when the door is moved to the open position.

3. The refrigerator as claimed in claim 1, wherein the insulated compartment door includes an inner door liner and further includes a pair of door plates attached to the inner door liner, wherein the links are mounted on the door plates.

4. A refrigerator having at least one insulated compartment, comprising:

a pair of fixed slides attached to opposite side walls of the inner surface of the at least one compartment;

a pair of movable slides combined with the fixed slides to be movable forward and back with respect to the fixed slides and having a distal end;

a door pivot connected to each of the movable slides adjacent the distal end;

an insulated compartment door pivotally mounted to the door pivots for movement with the movable slides between a closed position closing the insulated compartment and an open position;

a food storage basket having opposite side walls with a basket pivot and a guide surface follower on each of the opposite side walls; and a support mechanism for mounting the food storage basket for movement with the compartment door and movable slides and for moving the food storage basket upward when the door is moved to the open position comprising:

a guide plate mounted to each of the movable slides and having a guide surface arranged to be engaged by a food storage basket guide surface follower;

a pair of links mounted to the insulated compartment door at one end and having a distal end, each link positioned on the insulated compartment door to be adjacent one of the food storage basket opposite side walls and having a first link pivot at the distal end to pivotally connect to a food storage basket pivot; and further including an elongated bracket attached to each of the movable slides and arranged to connect the guide plates to the movable slides, and wherein the door pivots are located on the brackets adjacent the distal end of the movable slides.

5. A refrigerator having at least one insulated compartment, comprising:

a pair of fixed slides attached to opposite side walls of the inner surface of the at least one compartment;

a pair of movable slides combined with the fixed slides to be movable forward and back with respect to the fixed slides and having a distal end;

an elongated bracket attached to each of the movable slides including a door pivot located on the bracket adjacent the distal end of the movable slide;

an insulated compartment door pivotally mounted to the door pivots for movement with the movable slides between a closed position closing the insulated compartment and an open position;

a first food storage basket having a front wall, opposite side walls, a rear wall and a bottom wall and having a basket pivot and a guide surface follower on each of the opposite side walls; and a support mechanism for mounting the first food storage basket for movement with the compartment door and movable slides and for rotating the first food storage basket upward from a lower position to an upper position when the door is moved to the open position comprising:

a guide plate mounted to each of the brackets and having a guide surface arranged to be engaged by a first food storage basket guide surface follower;

a pair of links mounted to the insulated compartment door at one end and having a distal end, each link positioned on the insulated compartment door to be adjacent one of the first food storage basket opposite side walls, and having a first link pivot at the distal end arranged to pivotally connect to a basket pivot and a second link pivot adjacent the one end arranged to pivotally connect to an elongated bracket door pivot to pivotally connect the insulated compartment door to the brackets attached to the movable slides.

6. The refrigerator as claimed in claim 5, wherein the guide surface followers comprise a roller arranged to roll along the guide surface to maintain the first food basket in a generally upright orientation as the first food storage basket is rotated upward when the door is moved to the open position.

7. The refrigerator as claimed in claim 5, wherein the insulated compartment door includes an inner door liner and further includes a pair of door plates attached to the insulated compartment door, wherein the links are mounted on the door plates.

8. The refrigerator as claimed in claim 5, further including a cover attached to each of the first food storage basket sidewalls and arranged to enclose the link between the cover and sidewall.

9. The refrigerator as claimed in claim 5, further including a latching mechanism to restrict rotation of the insulated compartment door until the door is in the open position, the latching mechanism comprising:

a second food storage basket having side walls and a bottom wall slidably mounted in the at least one insulated compartment above the first food storage basket including a pair of downwardly opening recessed channels in the bottom wall of the second food storage basket; and a pair of wheels rotatably mounted at the top of the rear wall of the first food storage basket arranged to engage the recessed channels when the first food storage basket rear wall is positioned below the second food storage basket;

whereby rotation of the insulated compartment door is restricted until the insulated compartment door is moved toward the open position to a position where the wheels no longer engage the recessed channels.

10. The refrigerator as claimed in claim 5, further including a latching mechanism to restrict rotation of the insulated compartment door until the door is in the open position, the latching mechanism comprising:

outwardly extending flanges at the top of the side walls of the first food storage basket arranged to engage slots adjacent the fixed slides on the side walls of the at least one compartment;

whereby rotation of the insulated compartment door is restricted until the insulated compartment door is moved toward the open position to a position where the flanges no longer engage the slots.

11. The refrigerator as claimed in claim 5, further including a latching mechanism to restrict rotation of the insulated compartment door until the door is in the open position, the latching mechanism comprising the door pivots and the second link pivots wherein:

the second link pivots further comprise a generally cylindrical pin attached to the link having parallel flat surfaces on the distal end of the pin;

the door pivots further comprise a generally keyhole shaped slot arranged to slideably receive the pin having a first portion having parallel walls sized to engage the parallel flat surfaces of the pin and having a second partial circular portion sized to rotatably support the rounded portion of the distal end of the pin;

whereby when the pin engages the first portion of the slot rotation of the pin in the slot is restricted and when the pin slides along the keyhole shaped slot and engages the second portion the pin can rotate in the slot allowing the insulated compartment door to pivot.

12. The refrigerator as claimed in claim 11, wherein the slot is inclined upwardly from the first portion to the second portion to bias the pin to the first portion.

13. A refrigerator having at least one insulated compartment, comprising:

a pair of fixed slides attached to opposite side walls of the inner surface of the at least one compartment;

a pair of movable slides combined with the fixed slides to be movable forward and back with respect to the fixed slides and having a distal end;

an elongated bracket attached to each of the movable slides including a door pivot located on the bracket adjacent the distal end of the movable slide;

an insulated compartment door pivotally mounted to the door pivots for movement with the movable slides between a closed position closing the insulated compartment and an open position;

a first food storage basket having a front wall, opposite side walls, a rear wall and a bottom wall and having a basket pivot and a guide surface follower on each of the opposite side walls; and a support mechanism for mounting the first food storage basket for movement with the compartment door and movable slides and for rotating the first food storage basket upward from a lower position to an upper position when the door is moved to the open position comprising:

a guide plate connected to each of the brackets and having a guide surface arranged to be engaged by a guide surface follower;

a pair of links connected to the insulated compartment door at one end and having a first link pivot at a distal end arranged to pivotally connect to a basket pivot and a second link pivot arranged to pivotally connect to a door pivot to pivotally connect the insulated compartment door to the brackets attached to the movable slides; and further including a stopper comprising the door pivots and second link pivots to limit rotation of the food storage basket between the lower position and the upper position, wherein the door pivots include an axially extending partial collar forming a first stopping surface and a second stopping surface, and the second link pivots include an axially extending partial collar forming a pin having a first surface and a second surface, whereby the links are arranged for limited rotation relative to the brackets between a first position where the first surface of the pin engages the first stopping surface and a second position where the second surface of the pin engages the second stopping surface.

14. The refrigerator as claimed in claim 13, wherein stopper allows the links to rotate approximately 90 degrees between the lower position and the upper position.

* * * * *